US006628913B2

(12) United States Patent
Matsumoto et al.

(10) Patent No.: US 6,628,913 B2
(45) Date of Patent: Sep. 30, 2003

(54) METHOD AND APPARATUS FOR REPLENISHING DEVELOPER WITH A FLEXIBLE POWDER CONTAINER

(75) Inventors: Junichi Matsumoto, Kanagawa-ken (JP); Nobuo Kasahara, Kanagawa-ken (JP); Nobuo Iwata, Kanagawa-ken (JP); Satoshi Muramatsu, Kanagawa-ken (JP); Tomoyuki Ichikawa, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/943,505

(22) Filed: Aug. 31, 2001

(65) Prior Publication Data

US 2002/0025196 A1 Feb. 28, 2002

(30) Foreign Application Priority Data

Aug. 31, 2000 (JP) ..... 2000-264389

(51) Int. Cl.[7] ..... G03G 15/08
(52) U.S. Cl. ..... 399/258; 222/DIG. 1
(58) Field of Search ..... 399/258, 262; 222/161, 164, 165, 166, 196, 202, 203, DIG. 1

(56) References Cited

U.S. PATENT DOCUMENTS

| | | | | |
|---|---|---|---|---|
| 3,127,065 A | * | 3/1964 | Stevenson | 222/164 |
| 5,172,169 A | | 12/1992 | Takashima et al. | 399/281 |
| 5,208,637 A | * | 5/1993 | Landa | 222/DIG. 1 |
| 5,220,383 A | | 6/1993 | Enoki et al. | 399/285 |
| 5,239,344 A | | 8/1993 | Enoki et al. | 399/285 |
| 5,245,391 A | | 9/1993 | Suzuki et al. | 399/285 |
| 5,286,918 A | | 2/1994 | Iwata et al. | 399/119 |
| 5,311,263 A | | 5/1994 | Suzuki et al. | 399/276 |
| 5,386,274 A | | 1/1995 | Sanpe et al. | 399/101 |
| 5,389,733 A | | 2/1995 | Enoki et al. | 399/104 |
| 5,394,231 A | | 2/1995 | Sudo et al. | 399/228 |
| 5,426,492 A | * | 6/1995 | Diehl | 222/DIG. 1 |
| 5,435,461 A | * | 7/1995 | Smith et al. | 222/DIG. 1 |
| 5,451,713 A | | 9/1995 | Suzuki et al. | 399/285 |
| 5,467,175 A | | 11/1995 | Takagaki et al. | 399/281 |
| 5,474,869 A | | 12/1995 | Tomita et al. | 430/102 |
| 5,508,794 A | | 4/1996 | Ikesue et al. | 399/120 |
| 5,561,506 A | | 10/1996 | Kasahara | 399/256 |
| 5,585,598 A | | 12/1996 | Kasahara et al. | 399/227 |

(List continued on next page.)

FOREIGN PATENT DOCUMENTS

| | | | |
|---|---|---|---|
| JP | 62-166377 | * | 7/1987 |
| JP | 3-168670 | * | 7/1991 |
| JP | 5-61347 | * | 3/1993 |
| JP | 5-265318 | * | 10/1993 |
| JP | 8-240977 | * | 9/1996 |
| JP | 9-244372 | * | 9/1997 |
| JP | 11-119536 | | 4/1999 |
| JP | 11-143195 | | 5/1999 |
| JP | 11-327275 | * | 11/1999 |
| JP | 2000-194182 | | 7/2000 |
| JP | 2000-203549 | * | 7/2000 |

*Primary Examiner*—Fred L. Braun
(74) *Attorney, Agent, or Firm*—Oblon, Spivak, McClelland, Maier & Neustadt, P.C.

(57) ABSTRACT

A powder replenishing device and method having a replaceable powder container and a reciprocating mechanism. The replaceable powder container is configured to contain a powder to be replenished to an associated apparatus and is made of a material which allows a change in volume of the replaceable powder container. The powder container has a powder discharge port which discharges the powder from the container. The reciprocating mechanism is configured to reciprocate the powder container such that the volume of the replaceable powder container changes on reciprocation and the powder moves toward the discharge port.

131 Claims, 11 Drawing Sheets

U.S. PATENT DOCUMENTS 5,627,630 A 5/1997 Matsumae et al. ..... 399/67
5,663,788 A 9/1997 Sanpe ..... 399/353
5,674,408 A 10/1997 Suzuki et al. ..... 216/39
5,741,616 A 4/1998 Hirano et al. ..... 430/101
5,797,074 A 8/1998 Kasahara et al. ..... 399/262
5,819,145 A 10/1998 Tanaka et al. ..... 399/274
5,864,733 A 1/1999 Mae et al. ..... 399/46
5,875,380 A 2/1999 Iwata et al. ..... 399/301
5,953,567 A 9/1999 Muramatsu et al. ..... 399/256
5,962,783 A 10/1999 Iwata et al. ..... 73/488
5,987,298 A 11/1999 Muramatsu et al. ..... 399/359
6,112,046 A 8/2000 Suzuki et al. ..... 399/359
6,128,459 A 10/2000 Iwata et al. ..... 399/301
6,142,690 A 11/2000 Yoshimura et al. ..... 399/299 X
6,163,669 A 12/2000 Aoki et al. ..... 399/159
6,198,895 B1 3/2001 Tsuda et al.
6,201,941 B1 3/2001 Kasahara et al. ..... 399/258
6,282,396 B1 8/2001 Iwata et al. ..... 399/301
6,295,437 B1 9/2001 Hodoshima et al. ..... 399/346
6,335,137 B1 1/2002 Suzuki et al.
6,337,957 B1 1/2002 Tamaki et al.
6,381,435 B2 4/2002 Shinohara et al. ..... 399/301
6,393,241 B1 5/2002 Matsumoto et al. ..... 399/258
6,403,275 B1 6/2002 Kuramoto et al.
6,442,364 B2 8/2002 Kai et al.
6,468,706 B2 10/2002 Matsuda et al.
6,501,913 B2 12/2002 Hattori et al.
6,507,718 B2 1/2003 Ohjimi et al.
6,526,246 B2 * 2/2003 Iwata et al. ..... 399/258

* cited by examiner

METHOD AND APPARATUS FOR REPLENISHING DEVELOPER WITH A FLEXIBLE POWDER CONTAINER

BACKGROUND OF THE INVENTION

1. Field of the Invention

The present invention relates to a method and apparatus for image forming, and more particularly to a method and apparatus for image forming capable of effectively replenishing developer.

2. Description of the Related Art

Conventionally, a toner replenishing device is known for replenishing toner to a developing unit in an image forming apparatus such as a copier, a facsimile and a printer. This toner replenishing device has a replaceable toner container and replenishes toner in the toner container into a developer replenishing path of the developing unit. With this toner replenishing device, at the time the toner in the container is used up, the empty toner container is replaced by a new toner container filled with toner.

For example, as illustrated in FIG. 20, a known toner replenishing device has a movable member 112 such as a screw or a spring coil within a toner container 111. This toner replenishing device drives a rotating shaft 112*a* of the movable member 112 to convey toner in the toner container 111 toward a discharge port 111*a* through which the toner is replenished into a developer replenishing path.

Also, as illustrated in FIG. 21, another known toner replenishing device employs a cylindrical toner container, called a screw bottle 211, which is formed with a spiral protrusion 212 along the circumferential direction on the inner peripheral surface. This toner replenishing device drives the screw bottle 211 to convey toner in the screw bottle to a discharge port 211*a* through which the toner is replenished into a developer replenishing path.

However, when the movable member is employed in the toner replenishing device, the movable member must be assembled in the toner container, causing an increase in a cost for replacing the toner container. Also, since the movable member is driven by a power source external to the toner container, the toner container is formed with an opening for a power transmission member. Therefore, a sealing member is also required for sealing the opening, thereby resulting in a complicated structure of the toner container. Likewise, when the screw bottle is employed, the spiral protrusion must be formed on the inner peripheral surface thereof, and a complicated structure of the toner container is inevitable.

To address the problems mentioned above, the present inventors had developed a toner replenishing device which uses a toner container which is simple in structure and low in cost, without a movable member or spiral protrusion, and can replenish toner in the toner container into a developing apparatus. This toner replenishing device uses a toner container in the shape of rectangular solid, for example, which is simple in structure and low in cost, and includes a reciprocating mechanism for reciprocating the toner container such that the toner in the container moves toward a discharge port formed in the toner container. In this toner replenishing device, the toner gradually moves toward the discharge port by the action of an accelerated reciprocation and inertia generated in the toner in the toner container, and is eventually discharged from the discharge port.

The foregoing toner replenishing device can solve problems such as a complicated structure of the toner container, and an associated increase in cost for replacing the toner container. However, if the toner container is made of a rigid material which does not permit a change in volume of the container, the following problem arises in recovering used toner containers associated with the replacement of toner containers. Specifically, used or empty toner containers are recovered by a manufacturer from users, and recycled for reuse or discarded by incineration. If toner containers are made of rigid materials, the toner containers are bulky, and therefore have a low transport efficiency and a high distribution cost. Also, for transporting newly produced toner containers to locations to be filled with toner, similar disadvantages are experienced.

It should be noted that the foregoing problems arise not only in toner replenishing devices having a toner container for containing toner to be replenished to developing units of image forming apparatuses but also in any powder replenishing apparatus which has a replaceable powder container for replenishing powder in the powder container to an apparatus which requires supplementary powder.

The present invention has been made in view of the foregoing problems, and its first object is to provide a powder replenishing device for use with a simple and low cost powder container, which is capable of satisfactorily replenishing powder and reducing a distribution cost for the powder container.

Also, a second object of the present invention is to provide a developing apparatus and an image forming apparatus which are capable of reducing a cost for replacing a developer container and performing satisfactory developing by incorporating a developer replenishing device for use with a simple and low cost developer container to satisfactorily replenish a developer and reduce a distribution cost for the developer container.

SUMMARY OF THE INVENTION

The present invention provides a novel powder replenishing device for replenishing powder into an associated apparatus which requires supplementary powder. In one example, a novel powder replenishing device includes a replaceable powder container and a reciprocating mechanism. The replaceable powder container is made of a material which allows a change in volume for containing powder replenished to the apparatus. The powder container has a powder discharge port for discharging the powder on one side wall near one end thereof. The reciprocating mechanism is configured to reciprocate the powder container such that the powder moves toward the discharge port.

The powder container, especially the powder discharge port, may include a rigid member engaged therewith or may be partially made of a rigid material.

The present invention provides another novel powder replenishing device for replenishing powder into an associated apparatus which requires supplementary powder. In one example, a novel powder replenishing device includes a replaceable powder container and a reciprocating mechanism. The replaceable powder container is made of a material which allows a change in volume for containing powder replenished into the apparatus. The powder container has an inner container formed with a powder discharge port for discharging the powder on one side wall near one end thereof and a cover container made of a rigid material for covering the inner container except for the discharge port. The reciprocating mechanism is configured to reciprocate the powder container such that the powder moves toward the discharge port.

The reciprocating mechanism may reciprocate the powder container with the powder discharge port oriented downward in the vertical direction.

The above-mentioned one side wall may be inclined such that the powder in the powder container falls toward the powder discharge port.

In the above-mentioned powder replenishing device, a magnitude of acceleration produced when the powder container advancing with respect to a direction in which the powder moves to the powder discharge port is stopped is larger than the magnitude of acceleration produced when the powder container retracting with respect to the direction is stopped. That is, the inertia of the powder in the container advances the powder in an advancing direction toward said powder discharge port, while the container is moving in the advancing direction.

The reciprocating mechanism may include an urging mechanism, a pressively-moving mechanism, a press releasing mechanism, and a stopper. The urging mechanism is configured to urge the powder container to the advancing direction. The pressively-moving mechanism is configured to pressively move the powder container to the retracting direction against an urging force of the urging mechanism. The press releasing mechanism is configured to release the powder container from the movement forced by the pressively-moving mechanism. The stopper is configured to come in contact with the powder container moving in the advancing direction to stop the powder container.

In the above-mentioned powder replenishing device, a magnitude of acceleration produced when the powder container retracting with respect to a direction in which the powder moves to the powder discharge port is stopped is larger than the magnitude of acceleration produced when the powder container advancing with respect to the direction is stopped. That is, the inertia of the powder in the container advances the powder in an advancing direction toward said powder discharge port, while the container is moving in the retracting direction. The above-mentioned reciprocating mechanism may include an impact applying mechanism configured to repeatedly apply the powder container with an impact force such that the powder container is moved in the retracting direction and a moving mechanism configured to move, in an advancing direction, the powder container which has been moved in the retracting direction.

The moving mechanism may include an elastic member disposed between the powder container and a device body in the retracting direction.

The elastic member may include a leaf spring oscillably attached to the device body.

The elastic member may include an elastic foam.

The impact applying mechanism may includes a leaf spring oscillably attached to the device body and a moving mechanism configured to move toward the powder container by a resilient force of the leaf spring to collide with the powder container, the moving mechanism being supported by the leaf spring.

The above-mentioned powder replenishing device may further include an impact damping mechanism configured to mitigate the impact force to the device body.

The above-mentioned powder replenishing device may further include a container deforming mechanism configured to deform the powder container associated with the reciprocation.

The above-mentioned powder replenishing device may further include a container deforming mechanism configured to deform the inner container associated with the reciprocation.

The container deforming mechanism may deform the powder container near the powder discharge port.

The container deforming mechanism may deform the inner container near the powder discharge port.

The container deforming mechanism may reciprocate the powder container with the powder container partially fixed to the device body.

The above-mentioned powder replenishing device may further include a container holding member configured to reciprocate together with the powder container while supporting the powder container for reciprocation. In this case, the powder container is movable relative to the container holding member in directions of the reciprocation and the container deforming mechanism is configured to collide the powder container with the container holding member associated with the reciprocation.

The inner container may be movable relative to the cover container in directions of the reciprocation, and the container deforming mechanism may be configured to collide the inner container with the cover container associated with the reciprocation.

The powder container may include an air filter for passing air and blocking powder.

The inner container may include an air filter for passing air and blocking powder.

The powder container may have an external shape of rectangular solid.

The present invention further provides a novel method of replenishing powder into an associated apparatus which requires supplementary powder. In one example, a novel method of replenishing powder into an associated apparatus which requires supplementary powder includes the steps of providing and reciprocating. The providing step provides a replaceable powder container for containing powder replenished to the apparatus. The powder container is made of a material which allows a change in volume and having a powder discharge port for discharging the powder on one side wall near one end thereof. The reciprocating step reciprocates the powder container such that the powder moves toward the discharge port.

The powder container may include a rigid member engaged therewith.

The powder container may be partially made of a rigid material.

The present invention further provides a novel method of replenishing powder into an associated apparatus which requires supplementary powder. In one example, a novel method of replenishing powder into an associated apparatus which requires supplementary powder includes the steps of providing and reciprocating. The providing step provides a replaceable powder container for containing powder replenished into the apparatus. The powder container is made of a material which allows a change in volume and having an inner container formed with a powder discharge port for discharging the powder on one side wall near one end thereof and a cover container made of a rigid material for covering the inner container except for the discharge port. The reciprocating step reciprocates the powder container such that the powder moves toward the discharge port.

The reciprocating step may reciprocate the powder container with the powder discharge port oriented downward in the vertical direction.

The one side wall may be inclined such that the powder in the powder container falls toward the powder discharge port.

In the above-mentioned method, a magnitude of acceleration produced when the powder container advancing with respect to a direction in which the powder moves to the powder discharge port is stopped is larger than the magnitude of acceleration produced when the powder container retracting with respect to the direction is stopped.

The reciprocating step may include the steps of urging, pressively moving, releasing, and stopping. The urging step urges the powder container to the advancing direction. The pressively moving step moves the powder container to the retracting direction against an urging force by the urging step. The releasing step releases the powder container from the movement forced by the pressively moving step. The stopping step stops the powder container moving in the advancing direction.

In the above-mentioned method, a magnitude of acceleration produced when the powder container retracting with respect to a direction in which the powder moves to the powder discharge port is stopped is larger than the magnitude of acceleration produced when the powder container advancing with respect to the direction is stopped.

The reciprocating step may include the steps of repeatedly applying the powder container with an impact force such that the powder container is moved in the retracting direction and moving, in an advancing direction, the powder container which has been moved in the retracting direction.

The moving step may move the powder container with an elastic member disposed between the powder container and a device body in the retracting direction.

The elastic member may include a leaf spring oscillably attached to the device body.

The elastic member may include an elastic foam.

The applying step may include the steps of providing a leaf spring oscillably attached to the device body and moving toward the powder container by a resilient force of the leaf spring to collide with the powder container.

The above-mentioned method may further include a step of mitigating the impact force to the device body.

The above-mentioned method may further include a step of deforming the powder container associated with the reciprocation.

The above-mentioned method may further include a step of deforming the inner container associated with the reciprocation.

The deforming step may deform the powder container near the powder discharge port.

The deforming step may deform the inner container near the powder discharge port.

The deforming step may reciprocate the powder container with the powder container partially fixed to the device body.

The above-mentioned method may further include the steps of providing a container holder for reciprocating together with the powder container while supporting the powder container for reciprocation and the deforming step collides the powder container with the container holder associated with the reciprocation. In this case, the powder container is movable relative to the container holder in directions of the reciprocation.

The inner container may be movable relative to the cover container in directions of the reciprocation, and the deforming step collides the inner container with the cover container associated with the reciprocation.

The powder container may include an air filter for passing air and blocking powder.

The inner container may include an air filter for passing air and blocking powder.

The powder container may have an external shape of rectangular solid.

The present invention further provides a novel developing apparatus. In one example, a novel developing apparatus includes a developer replenishing device for replenishing a developer into a developer replenishing unit in the developing apparatus. This developer replenishing device includes a replaceable developer container and reciprocating mechanism. The replaceable developer container is made of a material which allows a change in volume for containing developer replenished to the apparatus. The developer container has a developer discharge port for discharging the developer on one side wall near one end thereof. The reciprocating mechanism is configured to reciprocate the developer container such that the developer moves toward the discharge port.

The present invention further provides a novel image forming apparatus. In one example, a novel image forming apparatus includes a developing unit and a developer replenishing device. The developing unit develops a latent image formed on an image carrier. The developer replenishing device replenishes a developer into the developing unit. The developer replenishing device includes a replaceable developer container and reciprocating mechanism. The replaceable developer container is made of a material which allows a change in volume for containing developer replenished to the developing unit. The developer container has a developer discharge port for discharging the developer on one side wall near one end thereof. The reciprocating mechanism is configured to reciprocate the developer container such that the developer moves toward the discharge port.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

[Embodiment 1]

In the following, a powder replenishing device according to the present invention will be described for an embodiment in which the powder replenishing device is applied to a toner replenishing device in a developing unit of an electrophotographic copier (hereinafter called the "copier").

Figure 1:
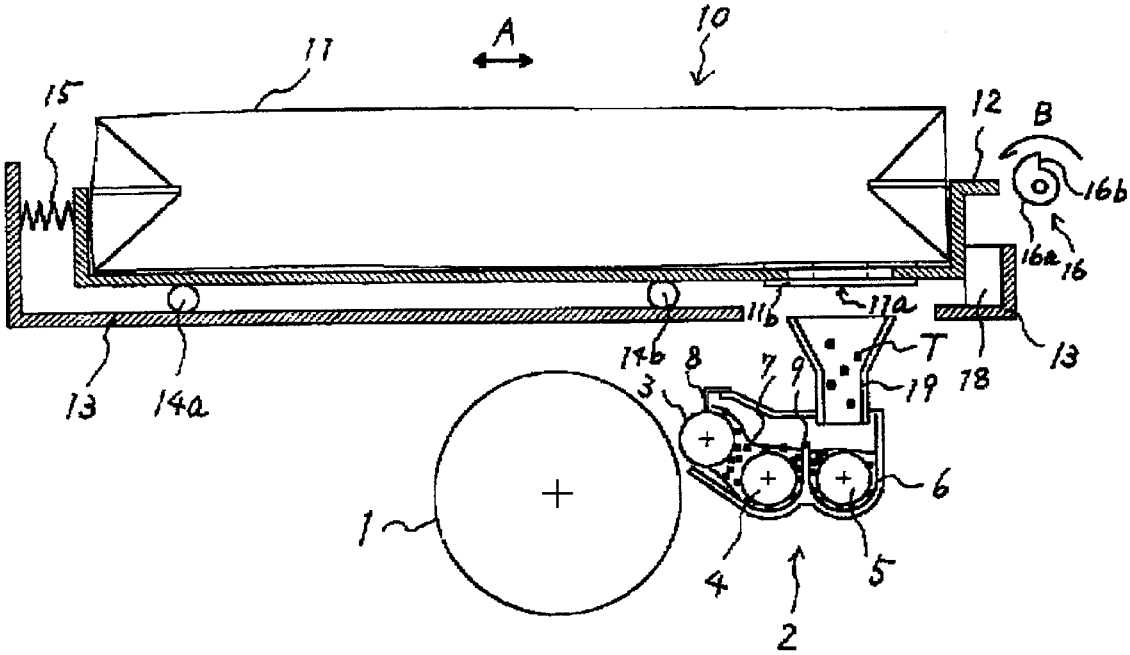
FIG. 1 is a schematic diagram illustrating the structure of an image forming section of a copier according to an embodiment of the present invention.

FIG. 1 generally illustrates the structure of an image forming section in a copier according to this embodiment.

The illustrated image forming section includes, around a photosensitive drum 1 functioning as a latent image carrier, a charger for uniformly charging the surface of the photosensitive drum 1; an exposure optical system for focusing a light image of an original document on the surface of the photosensitive drum 1 to form an electrostatic latent image; a developing unit 2; a transfer unit (not shown) for transferring a toner image produced by developing the electrostatic latent image by the developing unit 2 onto a transfer sheet, which is a recording medium; and a cleaning unit (not shown) for scraping toner remaining on the photosensitive drum 1 after the toner image has been transferred. A toner replenishing device 10 is attached to the developing unit 2 for replenishing toner thereto. Since overall operations involved in making a copy in the copier are represented by the known electro-photographic process, description thereon is omitted.

The developing unit 2 is a two-ingredient developing unit which uses a so-called two-ingredient developer including toner and carrier. A developing casing 6 of the developing unit 2 contains a developer 7 which is a mixture of the toner and carrier. The developing casing 6 also includes a developing roller 3; conveyer screws 4, 5 for mixing and stirring toner T replenished through a toner receiver 19 of the toner replenishing device 10 with the developer 7 in the developing casing 6 and supplying the resultant mixture to the developing roller 3; and a regulator blade 8 for regulating the amount of developer on the developing roller 3.

The conveyer screws 4, 5 extend in parallel with each other in the depth direction in FIG. 1, and are driven to rotate in reverse directions to each other in a longitudinal direction of the developing roller 3 by a driver system, not shown. A partition 9 is disposed between the conveyer screws 4, 5 for individually defining spaces for containing the developer 7 around the conveyer screws 4, 5. However, the partition 9 does not extend to regions corresponding to the vicinities of both ends (near the proximal end and near the distal end) of the conveyer screws 4, 5, such that the two developer containing spaces communicate with each other near both ends. The toner T replenished from the toner replenishing device 10 into the developing unit 2 is mixed with the developer 7 and stirred with the rotations of the conveyer screws 4, 5, and conveyed to the developing roller 3. Then, the rotation of the developing roller 3 causes the toner T in the developer carried on the surface of the developing roller 3 to be supplied to a latent image formed on the photosensitive drum 1 to develop the latent image.

The following description will be centered on the toner replenishing device 10 which is a characteristic feature of the present invention.

Figure 2:
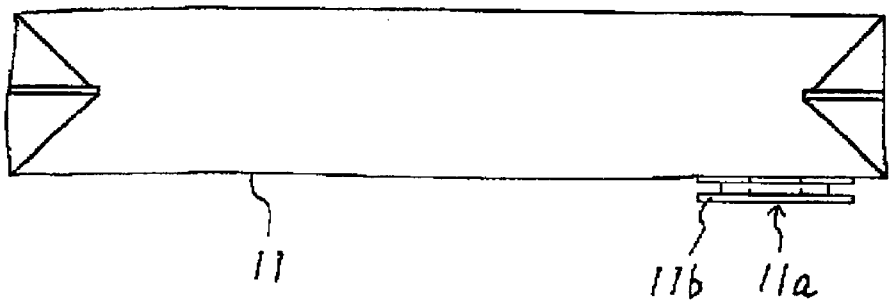
FIG. 2 is a schematic diagram illustrating a toner container of the copier of FIG. 1.

First, a toner container 11 of the toner replenishing device 10 will be described with reference to FIG. 2 which is an enlarged view of the toner container 11. The toner container 11 may be formed by a blow molding method, or the like, and made of a single layer or a plurality of layers of resin sheets made of polyethylene, Vyron (a registered trademark of a polymerized copolyester resin manufactured by Toyobo Co., Ltd., Japan) or the like or paper, for example, in a thickness of approximately 80–200 $\mu$m. The toner container 11 is a so-called flexible container which can change its volume. The toner container 11 has an external shape of a substantially rectangular solid, when it is inflated. A base 11*b* for forming a toner discharge port 11*a* is disposed on one side wall near one end thereof and has a pair of flanges which hold an opening of the container holding member 12, described below. In this embodiment, a rigid material such as metal is fitted on the sheet to form the base 11*b*. By making a portion of the toner container 11 rigid, the usability of the toner container can be improved. In addition, the base 11*b* includes a shutter member, not shown, so that the toner container 1 is held in a sealed state until it is set in the toner replenishing device 10.

It should be noted that the toner container 11 is not limited to a rectangular solid in shape, and may be a cylindrical container, by way of example. Also, aluminum may be deposited on the surface or back surface of the sheet as countermeasures to static electricity and humidity.

The toner container 11 is replaced with a new toner container filled with toner at the time the toner in the container has been used up. The empty or used toner container 11 is recovered by a manufacturer from a user and recycled for reuse or discarded (incinerated). In this embodiment, since the toner container 11 can be changed in volume, the toner container 11 provides a high usability when the user handles it, and reduces a distribution cost when it is recovered. In addition, it is possible to reduce a distribution cost for transporting newly produced toner containers 11 to locations where toner is replenished in apparatuses.

Advantageously, the base 11*b* may be made of the same material or a material belonging to the same family as the body of the container, in which case the base 11*b* need not be separated from the toner container 11 for recovery and reuse.

Next, description will be made on the structure and operation of the toner replenishing device 10.

Figure 3:
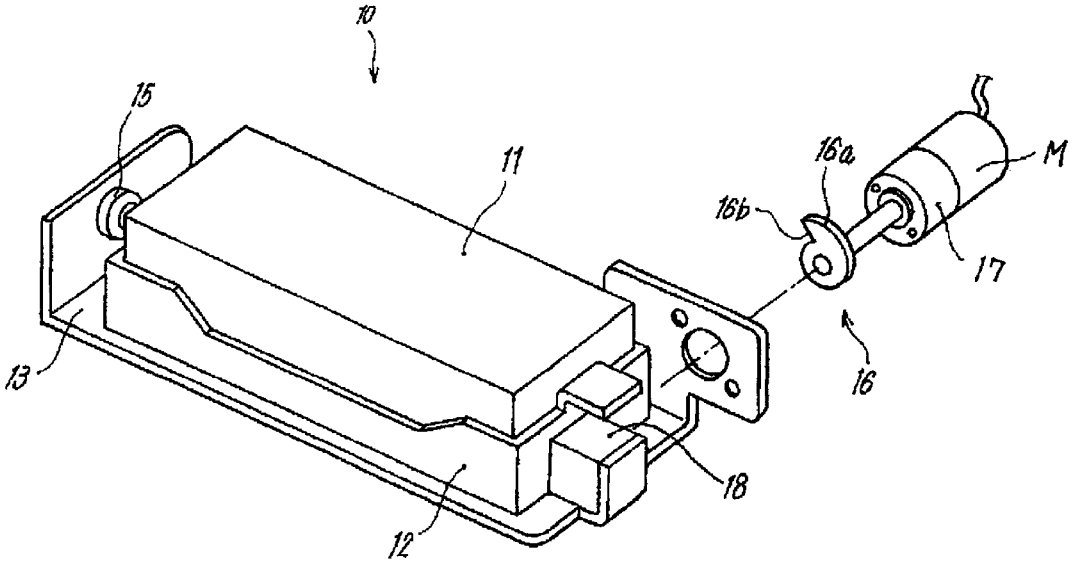
FIG. 3 is a perspective diagram schematically showing a toner replenishing device of the copier of FIG. 1.

FIG. 3 is a perspective view generally illustrating the structure of the toner replenishing device 10. As illustrated in FIGS. 1 and 3, the toner replenishing device 10 has the toner container 11, a container holding member 12, and a supporting base 13. The supporting base 13 is securely supported on a side plate of a developing apparauts, not shown, substantially in the horizontal direction. The container holding member 12 is removably mounted on the supporting base 13, while the toner container 11 is removably mounted on the container holding member 12 and the supporting base 13, for example, by fitting a flange of the base 11*b* in the opening of the container holding member 12.

For mounting the toner container 11 in the toner replenishing device 10, first, the container holding member 12 is taken out of the toner replenishing device 10. Then the base 11*b* of the toner container 11 is fitted on an opening formed through the container holding member 12, and both parts are integrated. Then, the toner container 11 integrated with the container holding member 12 is set on the supporting base 13 through rollers 14*a,* 14*b* such that the discharge port 11*a* of the toner container 11 integrated with the container holding member 12 is positioned opposite to an opening formed through the supporting base 13. After setting on the supporting base 13, the shutter member for sealing the base 11*b* is removed to open the toner discharge port 11*a*.

By thus setting the toner container 11 in the toner replenishing device 10, the toner container 11 and the container holding member 12 can be integrally moved on the supporting base 13 in a direction indicated by an arrow A with the discharge port 11*a* oriented downward in the vertical direction.

The toner replenishing device 10 further includes a reciprocating mechanism for reciprocating the toner container 11 such that the toner in the toner container 11 is moved toward the discharge port 11*a*. In this embodiment, the reciprocating mechanism includes a spring 15, functioning as an urging member, fixed on the supporting base 13 for urging the toner container 11 to the right in FIG. 1 through the container holding member 12; a cam 16 rotatably arranged such that its peripheral surface is in contact with an end of the container holding member 12 opposite to the end of the same which is in contact with the spring 15; and a damper 18, made of elastic rubber, fixed at an end of the supporting base 13. The cam 16 is driven by a motor M and a speed reduction gear 17 fixed on the supporting base 13 to rotate at an appropriately set rotational speed (see FIG. 3). Also, the cam 16 includes an eccentric cam face 16*a* and a step 16*b,* as illustrated, so that the cam 16 presses an end of the container holding member 12 to the left in FIG. 1 against an urging force of the spring 15 as it is rotated in a direction indicated by an arrow B to move the toner container 11 together with the container holding member 12, as described later in greater detail. The cam 16 also has a function of releasing such movement of the toner container 11.

In the foregoing description, the supporting base 13 and the damper 18 include a stopper for stopping the toner container 11 which moves to the right in FIG. 1.

Referring further to FIG. 1, as the cam 16 is driven by the motor M to rotate in a direction indicated by an arrow B, the eccentric cam face 16*a* of the cam 16 comes in contact with an end of the container holding member 12 to press the end against an urging force of the spring 15, causing the container holding member 12 and the toner container 11 to move to the left in FIG. 1 (outward stroke). As the cam 16 is further rotated so that the end of the container holding member 12 reaches the step 16*b,* the container holding member 12 is released from the movement forced by the cam face 16*a*. The urging force of the spring 15 forces the container holding member 12 and the toner container 11 to move rapidly to the right in FIG. 1 (return stroke). In this way, the toner container 11 reciprocates once in directions indicated by a double-headed arrow A each time the cam 16 is rotated once.

Then, the container holding member 12 and the toner container 11, moving rapidly to the right in FIG. 1, collide with the damper 18 secured on the supporting base 13, and stop after residual vibrations. At the time the container holding member 12 and the toner container 11 stop, the toner container 11 is rapidly decelerated with respect to the right direction in FIG. 1, so that the toner in the container moves to the right in FIG. 1, i.e., toward the discharge port 11*a,* due to the inertia of the toner. Therefore, by repeating such reciprocation, the toner in the toner container 11 disposed substantially in the horizontal direction can be gradually moved toward the discharge port 11*a*.

The toner, which has reached the discharge port 11*a* after such movement, falls by its own gravity and is satisfactorily replenished into the developing apparatus 2 which requires supplementary toner.

In this way, the toner can be replenished by the action of the accelerated reciprocation and inertia produced in the toner contained in the toner container 11, so that the toner container 11 can be implemented by a simple and low cost toner container without requirements of a spiral protrusion formed in the toner container or a movable member such as a screw disposed in the toner container.

As described above, the toner replenishing device according to this embodiment employs the toner container 11 which is simple in structure and low in manufacturing cost and distribution cost, so that a cost for replacing the toner container 11 can be reduced. Also, since the toner in the toner container 11 can be satisfactorily replenished into the developing unit, the developing unit can provide satisfactory development and high quality images.

In this embodiment, the bottom of the toner container 11 may be inclined such that it rises toward the discharge port 11*a,* in which case the toner in the toner container 11 can be moved toward the discharge port 11*a* by setting the acceleration at the time the toner container 11 is stopped in the outward and return strokes such that the inertia of the toner in the right direction in FIG. 1 becomes larger than the component of of the weight of the toner acting to the left.

[Exemplary Modification 1]

Next, an exemplary modification to the reciprocating mechanism in the foregoing Embodiment 1 will be described with reference to FIGS. 4 and 5.

Figure 4:
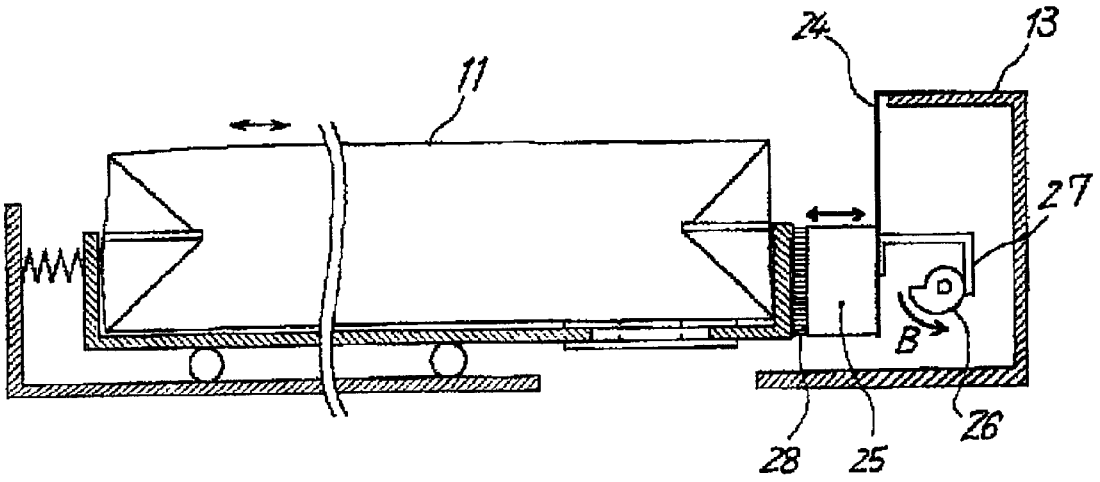
FIG. 4 is a schematic diagram illustrating a toner replenishing device according to a modification of the toner replenishing device of FIG. 3.

FIG. 4 generally illustrates the structure of the toner replenishing device 10 having a reciprocating mechanism according to this exemplary modification. In this exemplary modification, the reciprocating mechanism includes an impact applying mechanism for repeatedly applying an impact force to the toner container 11 through the container holding member 12 such that the toner container 11 is moved to the left in FIG. 4; and a spring 15 which functions as a mechanism for moving the toner container 11, which has moved to the left in FIG. 4, to the right. In this exemplary modification, the impact applying mechanism includes a leaf spring 24 oscillably attached to the supporting base 13; a weight 25, which functions as a movable member, supported by the leaf spring 24 for movement toward the toner container 11 by a resilient force of the leaf spring 24 to collide with the toner container 11 through the container holding member 12.

Figure 5:
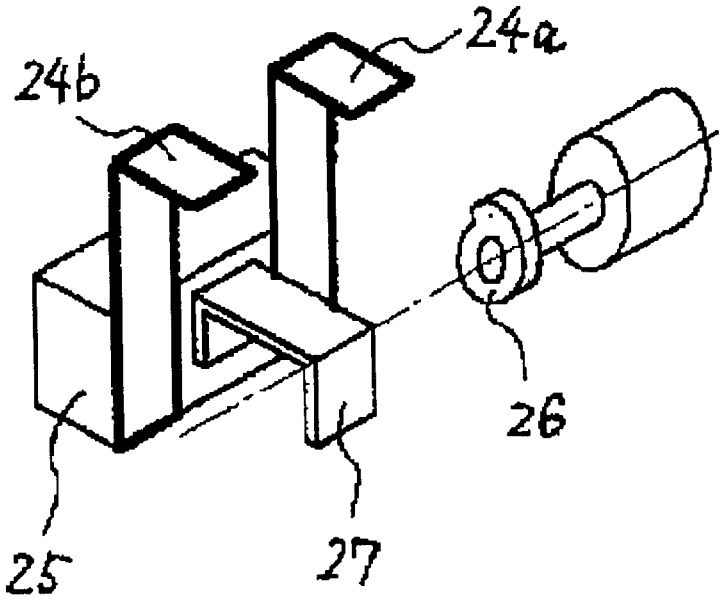
FIG. 5 is a perspective diagram schematically illustrating an impact applying mechanism of the toner replenishing device of FIG. 4.

FIG. 5 is a perspective view generally illustrating the structure of the impact applying mechanism. As illustrated in FIGS. 4 and 5, two leaf springs 24*a,* 24*b* have their bases attached to the supporting base 13, and their free ends to which a weight 25 is fixed. A cam contact member 27 is fixed to the weight 25, and a cam 26 is disposed such that its peripheral face is in contact with a face of the contact member 27 opposite to that fixed to the weight 25. Further, a damping member 28 is disposed on a surface of the weight 25 which collides with the container holding member 12, functioning as an impact damping mechanism for mitigating an impact force to the toner container 11.

As the cam 26 is driven by the motor M to rotate in a direction indicated by an arrow B in FIG. 4, the eccentric cam face of the cam 26 comes in contact with an end face of the cam contact member 27 which is pushed out to the right in FIG. 4 against an urging force of the leaf spring 24. This causes the leaf spring 24 and the weight 25 to rock about the joint fixed to the supporting base 13 and move to the right in FIG. 4. As the cam 26 is further rotated so that the end face of the cam contact member 27 reaches the step of the cam 26, the cam contact member 27 is released from the movement forced by the cam 26. An urging force of the leaf spring 24 causes the weight 26 to rapidly move to the left in FIG. 4 and collide with the toner container 11 through the container holding member 12. This collision applies the toner container 11 with an impact force, so that the toner container 11 is moved with large acceleration to the left in FIG. 4 (outward stroke). Then, the movement of the toner container 11 to the left in FIG. 4 causes elastic deformation of the spring 15. The impact energy absorbed by the elastic deformation is stored as internal deformation energy which acts as a restoring force when the spring 15 restores. The restoration of the spring 15 causes the toner container 11 to move to the right in FIG. 4 (return stroke). In this way, the toner container 11 is moved to the right in FIG. 4 making use of the characteristic of the spring 15, rather than a mechanism, thereby making it possible to simplify the device and reduce the cost without a complicated structure.

In the foregoing structure, since the impact force applied to the toner container 11 largely increases the acceleration in the outward stroke in which the toner container 11 is moved to the left in FIG. 4, the toner can be moved toward the discharge port 11*a* by the inertia of the toner contained in the toner container 11 when the toner container 11 is accelerated in the left direction. Also, since the damping member 28 can mitigate the impact to the toner replenishing device and hence the developing unit 2 and the copier body, it is possible to reduce sound generated by the impact, and a defective image possibly produced due to the impact, even if it is applied to the toner container 11 during development (image formation).

In this exemplary modification, the bottom of the toner container 11 may also be inclined such that it rises toward the discharge port 11*a.*

[Exemplary Modification 2]

Figure 6:
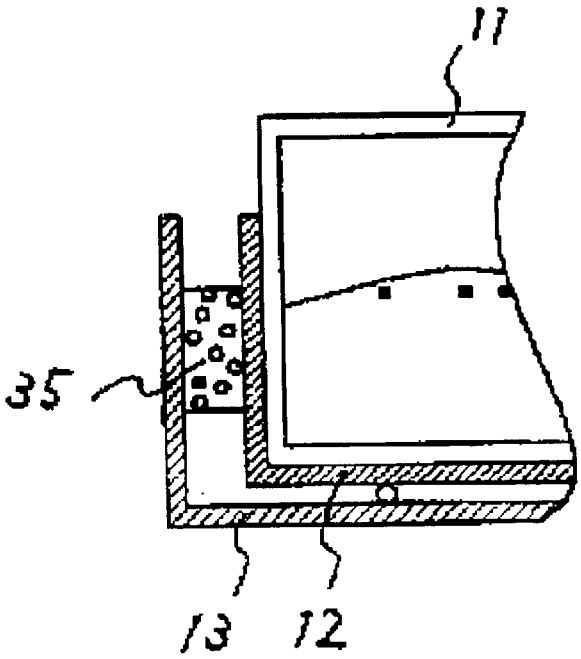
FIG. 6 is a schematic diagram partly illustrating a toner replenishing device according to another modification of the toner replenishing device of FIG. 3.

In the foregoing Exemplary Modification 1, the spring 15 is used as the mechanism for moving. Alternatively, an elastic foam 35 may be used instead of the spring 15, as illustrated in FIG. 6. With the use of the elastic foam 35 which is readily available at a relatively low cost, simplification and reduced cost can be achieved for the toner replenishing device. Also, since the elastic foam has a proper viscous resistance, noise can be mitigated thereby when the toner container 11 collides with the supporting base 13 through the elastic foam 35.

[Exemplary Modification 3]

Next, description will be made on another exemplary modification to the reciprocating mechanism in the aforementioned Embodiment 1.

Figure 7:
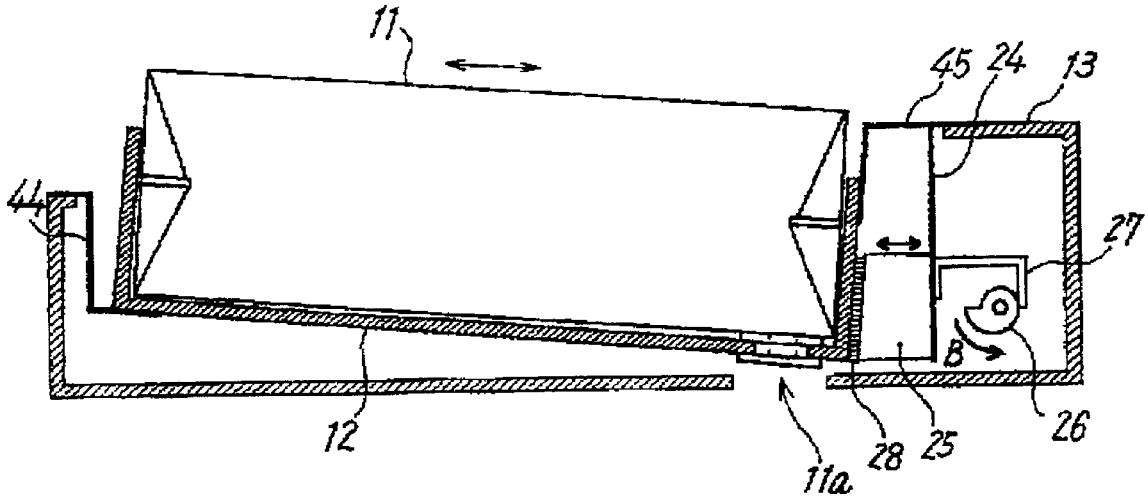
FIG. 7 is a schematic diagram illustrating a toner replenishing device according to another modification of the toner replenishing device of FIG. 3.
Figure 8:
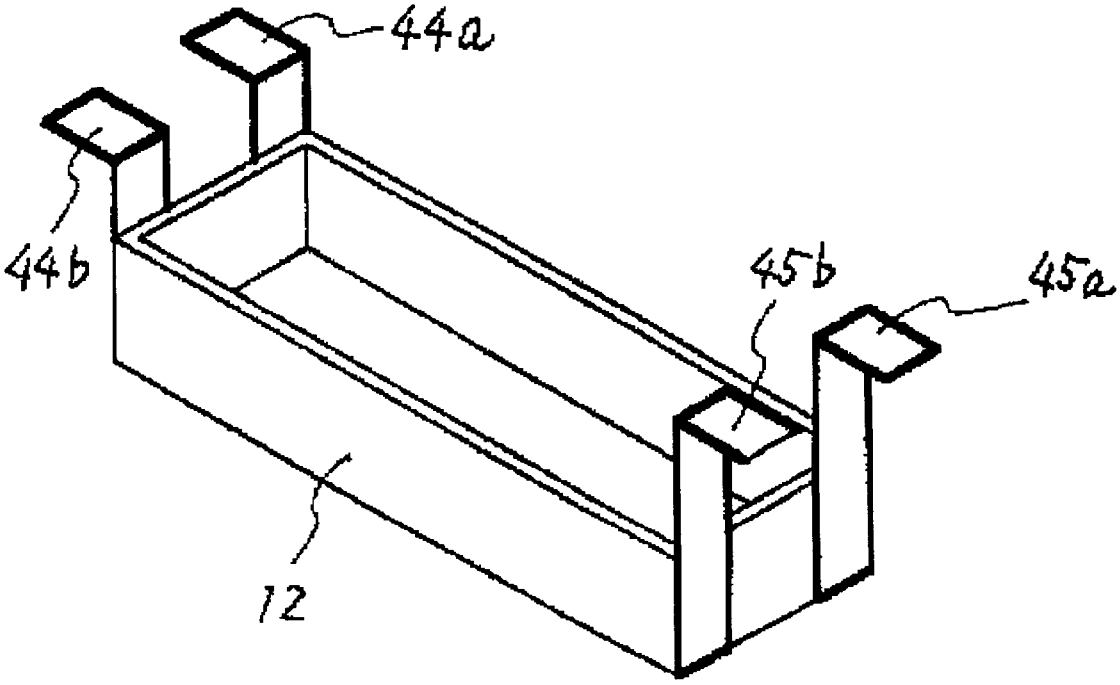
FIG. 8 is a perspective diagram schematically partly illustrating the toner replenishing device of FIG. 7.

FIG. 7 generally illustrates the configuration of the toner replenishing device 10 which includes a reciprocating mechanism according to this exemplary modification, and FIG. 8 is a perspective view illustrating a portion of the toner replenishing device 10. This exemplary modification includes an impact applying mechanism similar to that shown in the aforementioned Exemplary Modification 1. This exemplary modification differs from Exemplary Modification 1 in that the bottom of the toner container 11 is inclined such that it gradually falls toward the discharge port 11*a,* as illustrated in FIG. 7.

In this exemplary modification, as illustrated in FIGS. 7 and 8, the reciprocating mechanism includes leaf springs 44*a,* 44*b* oscillably attached to the supporting base 13; leaf springs 45*a,* 45*b* longer than the leaf springs 44*a,* 44*b;* and the impact applying mechanism. The toner container 11 is set on the container holding member 12 fixed to the four leaf springs, such that the bottom of the toner container 11 is inclined such that it gradually falls toward the discharge port 11*a.* Also, in the structure as illustrated, the leaf springs 44*a,* 44*b* on the left side have a function as a mechanism for moving the toner container 11 to the right in FIG. 7, and a function as a supporting mechanism for supporting the toner container 11 for reciprocation.

As described above, since the bottom of the toner container 11 is inclined, a component of the weight of the toner is generated in the direction in which the toner moves toward the discharge port 11*a.* Therefore, with the synergetic effect of the inertia of the toner generated by the impact force in the right direction in FIG. 7 and the weight of the toner, the toner in the toner container 11 can be more securely discharged.

[Exemplary Modification 4]

Figure 9:
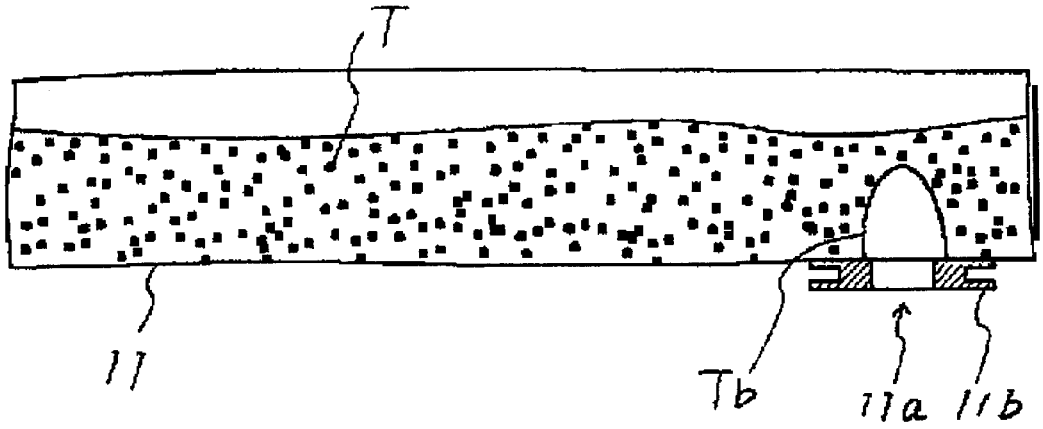
FIG. 9 is an illustration for explaining a problem caused when a toner bridge is formed.

In the aforementioned Embodiment 1 and Exemplary Modifications 1–3, the toner container 11 has the discharge port 11*a* oriented downward in the vertical direction, so that toner is prevented from depositing on the discharge port 11*a,* thereby preventing the closure of the discharge port 11*a* and a reduction in the amount of discharged toner due to the deposited toner compressed by gravity. However, depending on setting conditions such as the amount of toner contained in the toner container 11, the friction coefficient of the inner wall of the container, the size of discharge port 11*a,* the acceleration and stroke of the toner container 11 during the reciprocation, and so on, a large amount of toner in the container can move toward the discharge port 11*a* associated with the reciprocation, so that the toner could be discharged insufficiently from the discharge port 11*a* and therefore gradually agglutinated on the right-hand end face of the container. In such a state, the toner is not easily discharged by gravity. Specifically, only a portion of toner positioned above the discharge port 11*a* is discharged, but a partial or entire toner bridge Tb is formed over the discharge port 11*a* as illustrated in FIG. 9, resulting in a phenomenon called "blocking" by which subsequent discharge of the toner T is blocked.

To solve this problem, this exemplary modification provides a container deforming mechanism for deforming the toner container 11 together with the reciprocation to break a toner bridge possibly formed in the container or prevent the formation of a toner bridge.

Figure 10A:
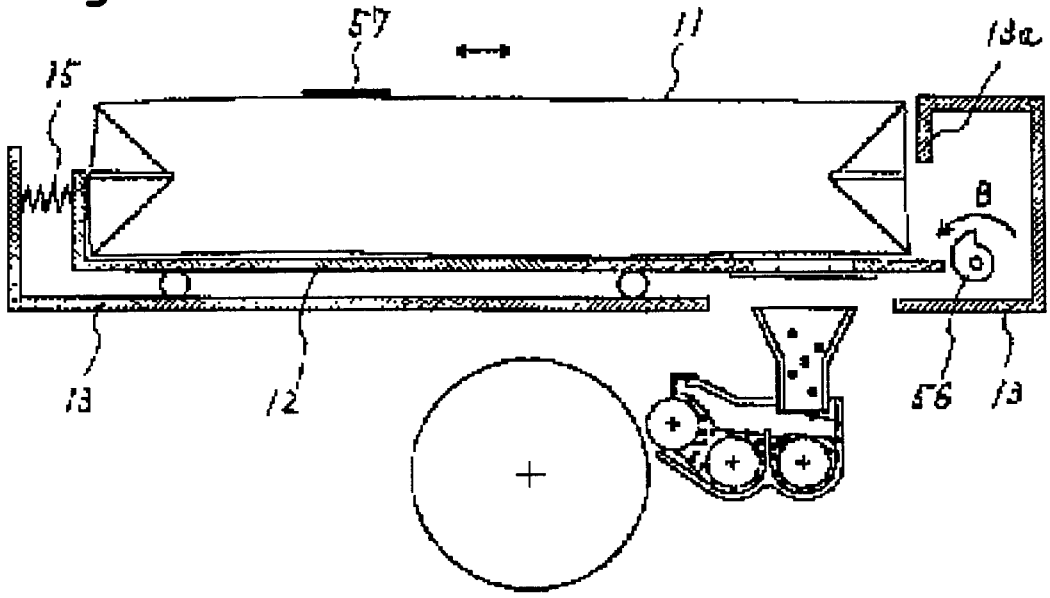
FIGS. 10A and 10B are schematic diagrams illustrating a toner replenishing device according to another modification of the toner replenishing device of FIG. 3.

FIG. 10A generally illustrates the structure of the toner replenishing device 10 which includes the container deforming mechanism. In this exemplary modification, the container deforming mechanism is implemented by a hood 13*a* on the left side of the supporting base 13. The toner replenishing device 10 also includes a cam 56 which has a similar function to the cam 16 in Embodiment 1, and a spring 15 which has a similar function to the spring 15 in Embodiment 1. Instead of the spring 15, an elastic foam may be used.

Figure 10B:
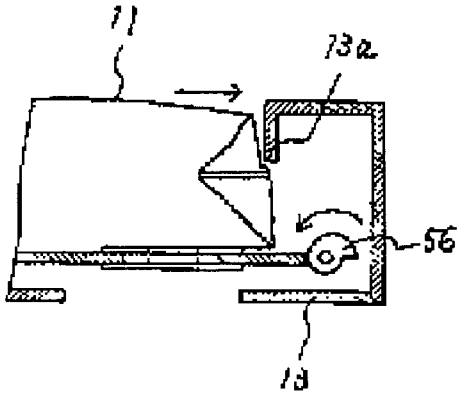

As the cam 56 is rotated in a direction indicated by an arrow B in FIG. 10A, the cam 56 presses an end of the container holding member 12 against an urging force of the spring 15, causing the container holding member 12 and the toner container 11 to move to the left in FIG. 10A (outward stroke). Next, the container holding member 12 is released from the movement forced by the cam 56. The urging force of the spring 15 causes the container holding member 12 and the toner container 11 to rapidly move to the right in FIG. 10A (return stroke). Then, the toner container 11, moving rapidly to the right in FIG. 10A, collides with the hood 13*a* of the supporting base 13. This collision results in deformation of the toner container 11, as illustrated in FIG. 10B, and the toner container 11 is stopped. In this way, the hood 13*a* has a function as the container deforming mechanism as well as a function as the stopper for stopping the movement of the toner container 11 to the right. At the time the toner container 11 is stopped, the toner in the container moves toward the discharge port 11*a* by the inertia of the toner in the toner container 11 in the right direction in FIG. 10A since large decceleration acts on the toner container 11 in the right direction.

In the foregoing structure, the toner container 11 is deformed near the discharge port 11*a,* associated with the reciprocation, so that a toner bridge, if formed in the container, can be effectively broken, or the formation of a toner bridge can be effectively prevented, thereby making it possible to stably replenish the toner in the container.

Figure 11:
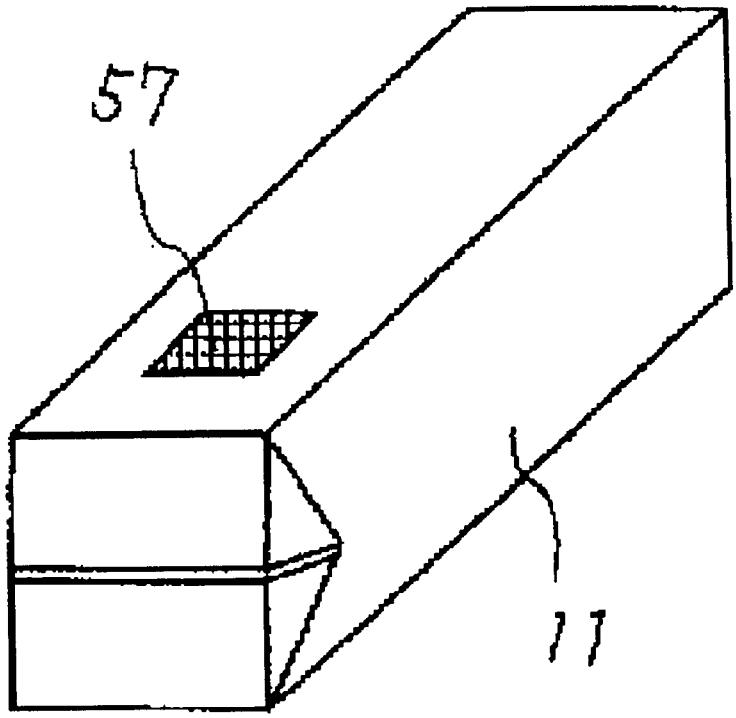
FIG. 11 is a perspective diagram schematically illustrating a toner container of the toner replenishing device of FIG. 10A.

In the foregoing structure, as illustrated in FIG. 11, the toner container 11 preferably includes an air filter 57 made of a material which passes air therethrough but blocks powder. With the provision of the air filter 57, external air can be supplied through the air filter 57, so that it is possible to impede the generation of negative pressure in the container and prevent the once deformed container from remaining in the deformed shape.

[Exemplary Modification 5]

Next, description will be made on another exemplary structure for the container deforming mechanism.

Figure 12A:
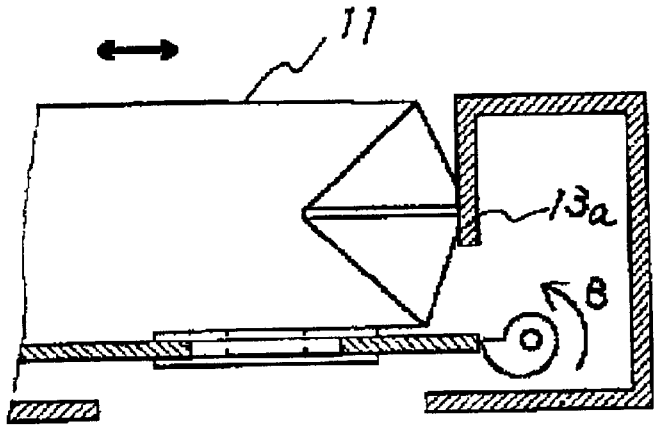
FIGS. 12A and 12B are schematic diagrams illustrating a toner replenishing device according to another modification of the toner replenishing device of FIG. 3.
Figure 12B:
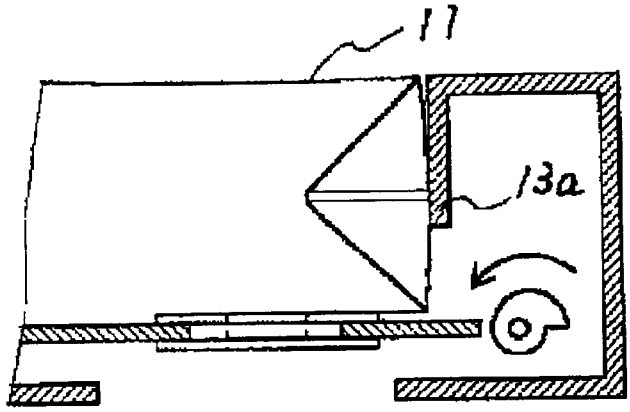
Figure 13:
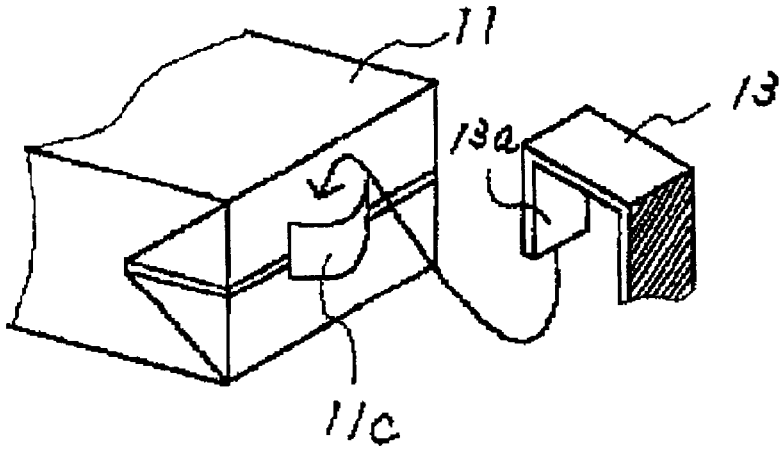
FIG. 13 is a schematic diagram illustrating another structure of the toner replenishing device of FIG. 12A.

FIGS. 12A, 12B generally illustrate the structure of a portion of the toner replenishing device 10 which includes a container deforming mechanism according to this exemplary modification. In this exemplary modification, the toner container 11 is reciprocated as described above with a portion of the toner container fixed to the device body to implement the container deforming mechanism. A portion of the toner container 11 may be fixed to the device body, for example, by fixing the portion of the toner container 11 to the supporting base 13 with a bonding agent or an adhesive tape when the toner container 11 is set in the toner replenishing device 10, or by providing the toner container 11 with a handle 11*c* which is engaged with the hood 13*a* of the supporting base 13, as illustrated in FIG. 13.

In the foregoing structure, the toner container 11 inflates as illustrated in FIG. 12A as it is moved to the left, and restores its original shape as illustrated in FIG. 12B as it is moved to the right. In this way, with a simple feature for fixing a portion of the toner container 11 to the supporting base 13, the toner container 11 can be deformed to stably replenish the toner in the container, associated with the reciprocation.

[Exemplary Modification 6]

In the foregoing Exemplary Modification 5, the toner container 11 is forced to collide with the supporting base 13 associated with the reciprocation to deform the toner container 11. Alternatively, the toner container 11 may be deformed by forcing the toner container 11 to collide with the container holding member 12. Specifically, for example, in the toner replenishing device of FIG. 1, the container holding member 12 is designed to have the longitudinal dimension larger than the longitudinal dimension of the toner container 11, so that the two components can move relative to each other in the directions of the reciprocation.

In the foregoing structure, as the container holding member 12 and the toner container 11, moving with acceleration to the right in FIG. 1, collide with the damper 18 secured on the supporting base 13, the toner container 11 moves to the right relative to the container holding member 12 with inertia produced in the toner container 11, causing the toner container 11 to collide with the container holding member 12. Since this collision results in deformation of the toner container 11, a toner bridge, if formed in the container, can be broken, or the formation of a toner bridge can be prevented. Since the toner container 11 can be deformed with the acceleration of the reciprocation and the inertia produced in the toner container 11 in the foregoing manner, the toner replenishing device can be implemented in a simplified structure and at a lower cost, as compared with the device separately provided with a member for deforming the toner container 11.

[Embodiment 2]

Next, a powder replenishing device according to the present invention will be described for an embodiment in which the powder replenishing device is applied to a toner replenishing device in a developing unit similar to that in Embodiment 1.

Figure 14:
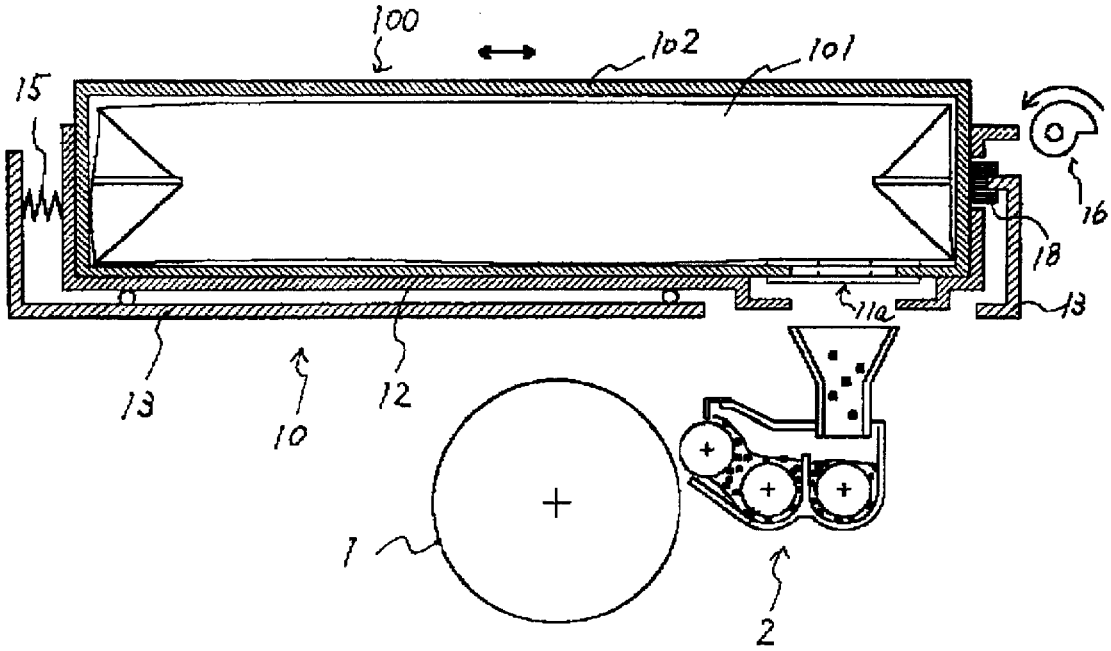
FIG. 14 is a schematic diagram illustrating the structure of a toner replenishing device according to another embodiment of the present invention, together with a photosensitive drum and a development apparatus.
Figure 15:
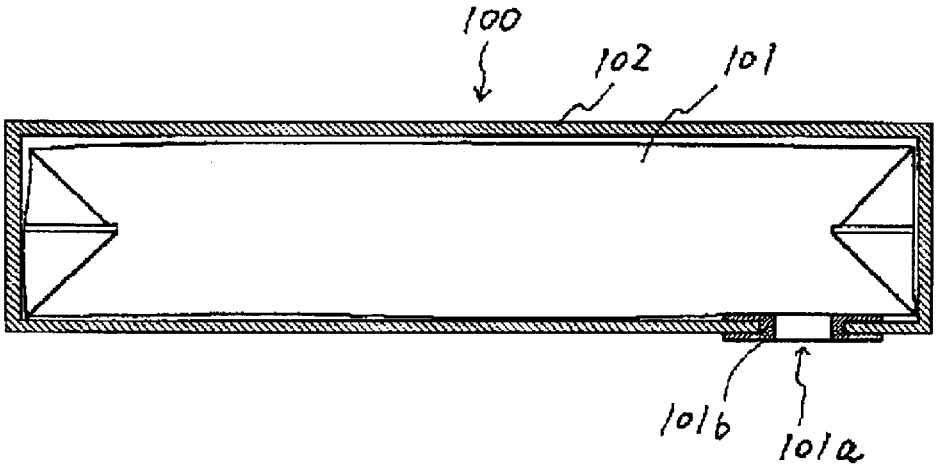
FIG. 15 is a schematic enlarged diagram illustrating a toner container of the toner replenishing device of FIG. 14.

FIG. 14 generally illustrates the structure of a toner replenishing device 10 according to this embodiment together with a developing unit 2 and a photosensitive drum 1. The toner replenishing device 10 is similar in basic structure and operation to the toner replenishing device 10 of FIG. 1, and the same reference numerals are given to corresponding members. The toner replenishing device of Embodiment 2 differs from that of the aforementioned Embodiment 1 in that a toner container 100 used herein includes an inner container 101 made of a material which allows a change in volume and having a base 101*b* for forming a toner discharge port 101*a* near an end of one side wall; and a cover container 102 made of a rigid material for covering the inner container 101 except for the discharge port 101*a*. FIG. 15 illustrates an enlarged view of the toner container 100 according to this embodiment. The inner container 101 is a flexible container similar to Embodiment 1. The cover container 102 in turn has an external shape of a rectangular solid and can be assembled and disassembled.

At the time toner in the inner container 101 has been used up, the user separates the used inner container 101 from the cover container 102 for replacement with a new inner container 101 filled with toner. The empty or used inner container 101 is recovered by a manufacturer from the user, and recycled for reuse or discarded (incinerated). In this embodiment, since the inner container 101 can be changed in volume, the inner container 101 provides a high usability when the user handles it and reduces a distribution cost when it is recovered. In addition, it is possible to reduce a distribution cost for transporting newly produced inner containers 101 to locations where toner is replenished in apparatuses.

Figure 16:
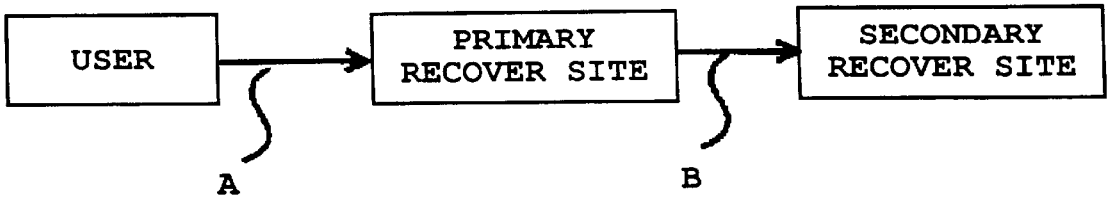
FIG. 16 is an illustration for explaining a route through which the toner container of FIG. 15 is recovered by a manufacturer.

Alternatively, at the time the toner in the inner container 101 has been used up, the manufacturer may recover the inner container 101 and the cover container 102 together, without forcing the user to separate the used inner container 101 from the cover container 102. In this case, as illustrated in FIG. 16, the manufacturer primarily recovers inner containers 101 and cover containers 102 together (distribution route A), and transports only the inner containers to a secondary recovery site for recovery after the inner containers 101 are separated from the cover containers 102 at a primary recovery site (distribution route B). In such an organization, a distribution cost can be reduced in the distribution route B.

In the structure illustrated in FIG. 14, as the cam 16 is driven by the motor M to rotate in a direction indicated by an arrow B in FIG. 14, the eccentric cam face of the cam 16 comes in contact with an end face of the cover container 102 which is pressed to the left in FIG. 14 against an urging force of the spring 15. This causes the toner container 100 and the container holding member 10 to move to the left in FIG. 14 (outward stroke). As the cam 16 is further rotated so that the end face of the cover container 102 reaches the step of the cam 16, the cover container 102 is released from the movement forced by the cam face. An urging force of the spring 15 causes the toner container 100 and the container holding member 12 to move rapidly to the right in FIG. 14 (return stroke). Then, the toner container 100, moving rapidly to the right in FIG. 14, stops as the cover container 102 collides with the damper 18 secured on the supporting base 13.

As described above, the toner replenishing device according to this embodiment employs the toner container 11 which is simple in structure and low in manufacturing cost and distribution cost, as is the case with the aforementioned Embodiment 1, so that a cost for replacing the toner container 11 can be reduced. Also, since the toner in the toner container 11 can be satisfactorily replenished into the developing unit, the developing unit can provide satisfactory development and high quality images.

This embodiment may employ as well the aforementioned Exemplary Modifications 1–3.

[Exemplary Modification 7]

Also, the foregoing embodiment may include a container deforming mechanism for deforming the inner container 101 associated with the reciprocation to break a toner bridge formed in the container or to prevent the formation of a toner bridge, in a manner similar to the aforementioned Exemplary Modification 4.

Figure 17A:
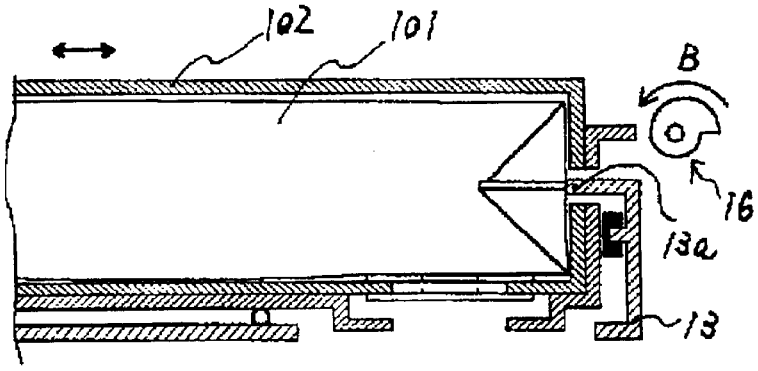
FIGS. 17A and 17B are schematic diagrams illustrating the structure of a toner replenishing device according to a modification of the toner replenishing device of FIG. 14.
Figure 17B:
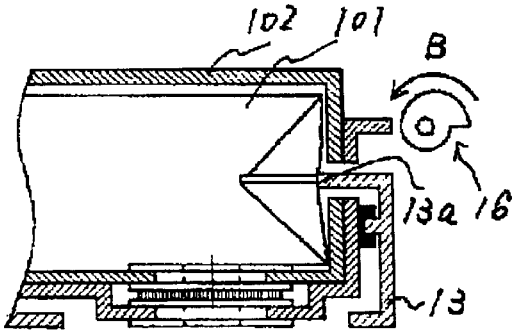

FIGS. 17A, 17B generally illustrate the structure of the toner replenishing device 10 which includes the container deforming mechanism. In this exemplary modification, the container deforming mechanism is implemented by a hood 13*a* on the right side of the supporting base 13, as in the aforementioned Exemplary Modification 4. The cover container 102 and the container holding member 12 are formed with openings for the hood 13*a* to extend through.

In the foregoing structure, as illustrated in FIG. 17B, the inner container 101 collides with the hood 13*a* of the supporting base 13 when the toner container 100 is moved to the right in FIG. 17B to cause deformation of the inner container 101 near the discharge port 101*a*. Since a toner bridge, if formed in the inner container, can be effectively broken, or the formation of a toner bridge can be effectively prevented, it is possible to stably replenish the toner into the container.

In this exemplary modification, the inner container 101 preferably includes an air filter made of a material which passes air therethrough but blocks powder.

[Exemplary Modification 8]

Figure 18:
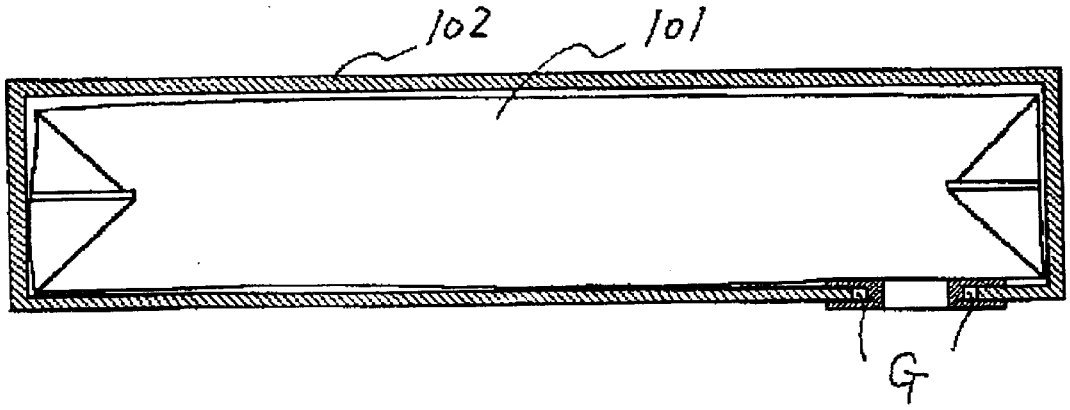
FIG. 18 is a schematic enlarged diagram illustrating a toner container according to a modification of the toner container of FIG. 15.

In Exemplary Modification 7, the inner container 101 is forced to collide with the supporting base 13 to deform the inner container 101. Alternatively, the inner container 101 may be deformed by forcing the inner container 101 to collide with the cover container 102. Specifically, as illustrated in FIG. 18, the toner container 100 in the toner replenishing device of FIG. 14 is structured such that a gap G is defined between the base 101*b* of the inner container 101 and the cover container 102, thereby allowing the inner container 101 and the cover container 102 to move relative to each other in the directions of the reciprocation.

When the toner container 100 in the foregoing structure is employed in the toner replenishing device illustrated in FIG. 14, the inner container 101 and the cover container 102, moving rapidly to the right in FIG. 14, collide with the damper 18 secured on the supporting base 13, which causes the inner container 101 to move by inertia to the right in FIG. 14 relative to the cover container 102, with the result that the inner container 101 collides with the cover container 102. This collision results in deformation of the inner container 101, so that a toner bridge, if formed in the inner container 101, can be broken, or the formation of a toner bridge can be prevented. Since the inner container 101 can be deformed by the acceleration of the reciprocation and the inertia produced in the inner container 101 in the foregoing manner, the toner replenishing device can be implemented in a simplified structure and at a lower cost, as compared with a like device separately provided with a member for deforming the toner container 101.

[Embodiment 3]

Next, a powder replenishing device according to the present invention will be described for an embodiment in which the powder replenishing device is applied to a carrier replenishing device in a developing unit of a copier similar to that in Embodiment 1. Since the copier is similar in basic configuration and operation to the copier of the aforementioned Embodiment 1, description thereon will be omitted.

Generally, a two-ingredient developing unit contains a developer which is a mixture of a toner and a carrier. Generally, only the toner in the developer is consumed in the development, while the carrier is repeatedly used. However, since the carrier deteriorates over time, the deteriorated carrier must be replaced with new carrier.

Figure 19:
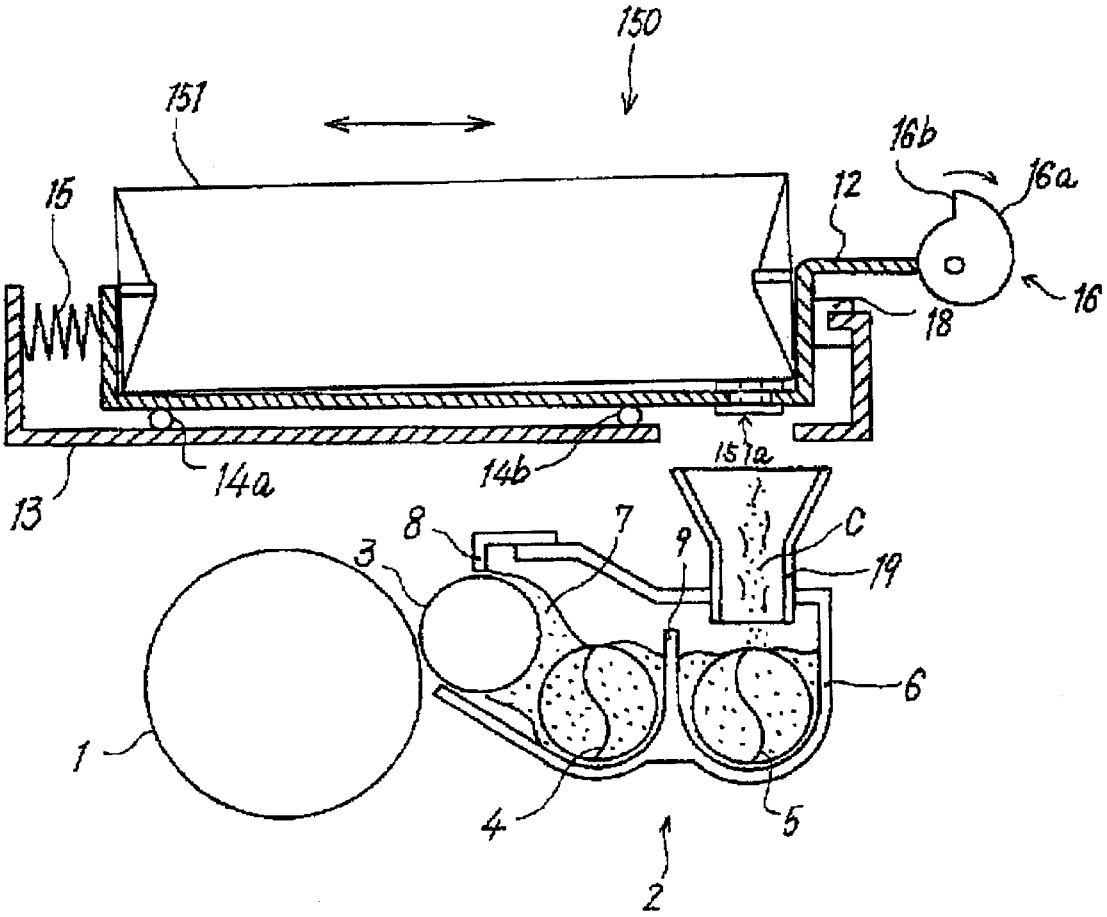
FIG. 19 is a schematic diagram partly illustrating a development apparatus according to another embodiment of the present invention.
Figure 20:
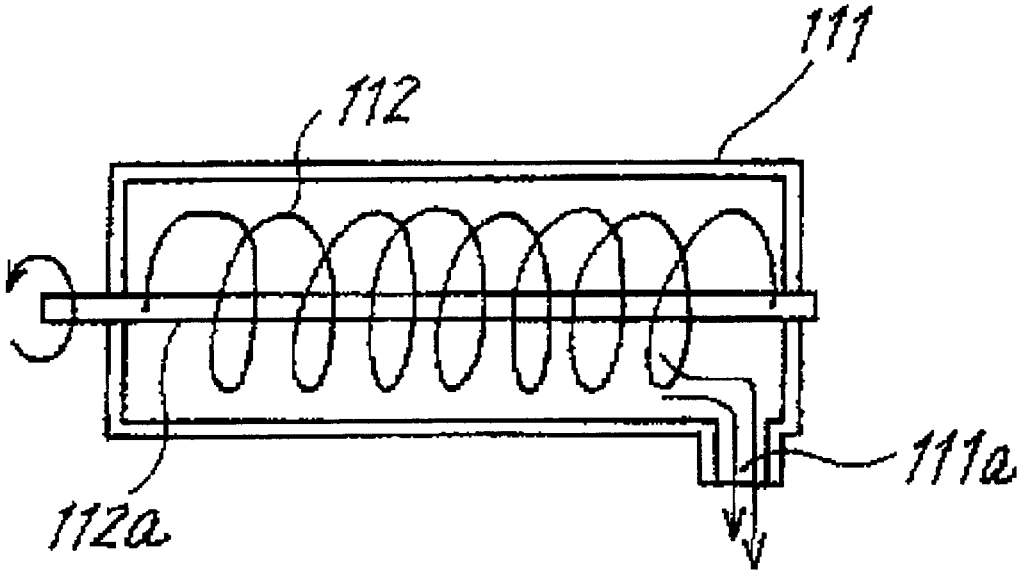
Fig. 20 (PRIOR ART)
FIG. 20 is a schematic diagram illustrating an exemplary background toner container.
Figure 21:
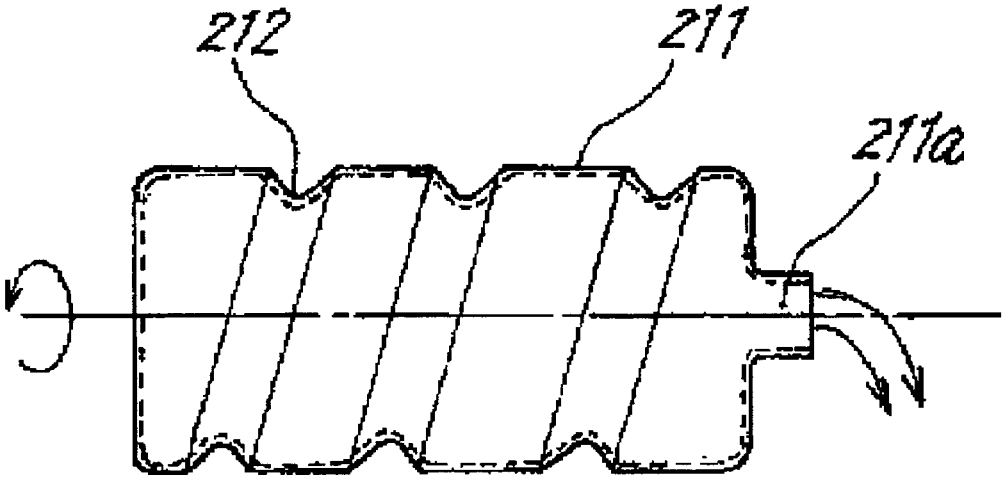
Fig. 21 (PRIOR ART)
FIG. 21 is a schematic diagram illustrating another exemplary background toner container.

FIG. 19 generally illustrates the structure of a developing unit 2 according to this embodiment, together with a photosensitive drum 1. The developing unit 2 of this embodiment includes a carrier replenishing device 150 for replenishing a new carrier C when a carrier has deteriorated; and a developer discharging mechanism, later described, for discharging a developer including a deteriorated carrier from the developing unit 2. In the developing unit 2 illustrated in FIG. 19, members having similar functions and actions to the component members of the developing unit 2 illustrated in FIG. 1 are designated using the same reference numerals, and description thereon is omitted. Also, though not illustrated, the developing unit 2 illustrated in FIG. 19 includes a separate toner replenishing device as illustrated in FIG. 1 for replenishing toner into the developing unit 2.

First, description will be made for the structure and operation of the carrier replenishing device 150.

Similar to the toner container 11 illustrated in FIG. 1, the carrier replenishing device 150 of this embodiment has a carrier container 151, including a so-called flexible container that can change its volume. The carrier container 151 has an external shape of a rectangular solid, and is formed with a discharge port 150*a* near an end of one side wall. The carrier container 151 is disposed on the carrier holding member 12 and the supporting base 13 such that the discharge port 151*a* is oriented downward in the vertical direction. The carrier replenishing device 150 also has a reciprocating mechanism, similar to that in the aforementioned Embodiment 1, for reciprocating the carrier container 151 to move a carrier C in the carrier container 151 toward the discharge port 151*a*. With this structure, the carrier C in the container can be moved to the right in FIG. 19, i.e., toward the discharge port 151*a* to replenish a new carrier C to the developing unit 2 with the accelerated reciprocation and the inertia of the carrier C in the carrier container 151 in the right direction in FIG. 19, as is the case with the aforementioned Embodiment 1.

Next, the developer discharging mechanism in this embodiment will be described.

In FIG. 19, a discharge conveyer screw 4 for discharging the developer is disposed adjacent to the conveyer screw 5 in a developing casing 6 of the developing unit 2. Between the conveyer screw 5 and discharge conveyer screw 61, a partition 9 is disposed extending in the depth direction in FIG. 19. The partition 9 has a low height section. In this structure, as the carrier C is replenished from the carrier replenishing device 150 because of the deteriorated carrier, the volume of the developer 7 is increased in a developer containing space in which the conveyer screw 5 is disposed. Eventually, the developer 7 goes beyond the partition 9 and flows out to the discharge conveyer screw 4. The flowing developer is conveyed by the discharge conveyer screw 4 toward the front in FIG. 19, and discharged to the outside of the developer unit 2 from a developer discharge port formed through a container wall of the developing casing 6 oriented downward in the vertical direction. Since the new carrier C can be replenished as the carrier is deteriorated, and the developer 7 including the deteriorated carrier can be discharged in the foregoing manner, it is possible to prevent the developing performance from degrading due to the deteriorated carrier.

The discharged developer 7 is collected in a developer recovery container which is positioned beneath the developing unit 2. When the carrier container 151 and the developer recovery container have the same volume, the developer recovery container is filled with the developer at the time the carrier in the carrier container 151 is used up, so that these containers can be replaced at the same time, thereby simplifying a replacement operation. Alternatively, a new developer previously prepared by mixing a carrier and a toner in a suitable ratio may be replenished into the developing unit instead of the new carrier C.

As described above, this embodiment can produce similar advantages to the foregoing Embodiment 1, and moreover can prevent degraded developing performance due to a deteriorated carrier.

This embodiment may employ as well the aforementioned Exemplary Modifications 1–6.

Also, this embodiment may employ the carrier container 151 similar to the toner container 100 shown in the aforementioned Embodiment 2 which includes an inner container made of a material which allows a change in volume, and a cover container made of a rigid material for covering the entire inner container except for a carrier discharge port of the inner container. In this case, the aforementioned Exemplary Modifications 7, 8 may be employed.

Obviously, numerous additional modifications and variations of the present invention are possible in light of the above teachings. It is therefore to be understood that within the scope of the appended claims, the present invention may be practiced otherwise than as specifically described herein.

This document is based on Japanese patent application No. JPAP2000-264389 filed on Aug. 31, 2000 in the Japanese Patent Office, the entire contents of which are incorporated by reference herein.

What is claimed is:

1. A powder replenishing device for replenishing powder into an associated apparatus which requires supplementary powder, comprising:

a replaceable powder container configured to contain said supplementary powder and made of a material which allows a change in volume of the replaceable powder container, said replaceable powder container having a powder discharge port; and a reciprocating mechanism configured to reciprocate said replaceable powder container such that the volume of the replaceable powder container is changed on reciprocation and the supplementary powder moves toward said discharge port.

2. A powder replenishing device according to claim 1, wherein said powder discharge port comprises a rigid member.

3. A powder replenishing device according to claim 1, wherein said powder container is partially made of a rigid material.

4. A powder replenishing device for replenishing powder into an associated apparatus which requires supplementary powder, comprising:

a replaceable powder container configured to contain said supplementary powder and made of a material which allows a change in volume of the replaceable powder container, said replaceable powder container having an inner container including a powder discharge port and having a cover container made of a rigid material covering a part of said inner container; and a reciprocating mechanism configured to reciprocate said replaceable powder container such that a volume of the inner container is changed on reciprocation and the supplementary powder moves toward said discharge port.

5. A power replenishing device according to claim 4, wherein said reciprocating mechanism reciprocates said powder container with said powder discharge port oriented downward.

6. A power replenishing device according to claim 4, wherein said powder discharge port is disposed in a side wall of the container which is inclined such that the powder in said powder container moves toward said powder discharge port by gravity.

7. A powder replenishing device according to claim 4, wherein said reciprocating mechanism is configured to decelerate the container such that the inertia of the powder in the container advances the powder in an advancing direction toward said powder discharge port, said deceleration of the container occurring while the container is moving in the advancing direction.

8. A powder replenishing device according to claim 7, wherein said reciprocating mechanism includes:

an urging mechanism configured to urge said powder container in the advancing direction;

a pressively-moving mechanism configured to pressively move said powder container in a retracting direction against an urging force of said urging mechanism;

a press releasing mechanism configured to release said powder container from the movement forced by said pressively-moving mechanism; and a stopper positioned to come in contact with said powder container moving in the advancing direction to stop said powder container.

9. A powder replenishing device according to claim 4, wherein said reciprocating mechanism is configured to decelerate the container such that the inertia of the powder in the container advances the powder in an advancing direction toward said powder discharge port, said deceleration of the container occurring while the container is moving in a retracting direction opposite said advancing direction.

10. A powder replenishing device according to claim 9, wherein said reciprocating mechanism includes:

an impact applying mechanism configured to repeatedly apply said powder container with an impact force such that said powder container is moved in the retracting direction; and a moving mechanism configured to move, in an advancing direction, said powder container which has been moved in the retracting direction.

11. A powder replenishing device according to claim 10, wherein said moving mechanism includes an elastic member disposed between said powder container and a device body.

12. A powder replenishing device according to claim 11, wherein said elastic member includes a leaf spring attached to said device body.

13. A powder replenishing device according to claim 11, wherein said elastic member includes an elastic foam.

14. A powder replenishing device according to claim 10, wherein said impact applying mechanism includes:

a leaf spring attached to said device body; and a moving mechanism configured to move toward said powder container by a resilient force of said leaf spring to collide with said powder container, said moving mechanism being supported by said leaf spring.

15. A powder replenishing device according to claim 10, further comprising an impact damping mechanism configured to mitigate an impact force to said device body.

16. A powder replenishing device according to claim 4, wherein said reciprocating mechanism includes a container deforming mechanism configured to deform said powder container.

17. A powder replenishing device according to claim 4, wherein said reciprocating mechanism includes a container deforming mechanism configured to deform said inner container.

18. A powder replenishing device according to claim 16, wherein said container deforming mechanism is positioned to deform said powder container near said powder discharge port.

19. A powder replenishing device according to claim 17, wherein said container deforming mechanism is positioned to deform said inner container near said powder discharge port.

20. A powder replenishing device according to claim 16, wherein said container deforming mechanism fixes said powder container to said device body.

21. A powder replenishing device according to claim 16, further comprising:

a container holding member configured to reciprocate together with said powder container while supporting said powder container for reciprocation, wherein said powder container is movable relative to said container holding member in directions of the reciprocation, and said container deforming mechanism is configured to collide said powder container with said container holding member.

22. A powder replenishing device according to claim 17, wherein said inner container is movable relative to said cover container in directions of reciprocation, and said container deforming mechanism is configured to collide said inner container with said cover container.

23. A powder replenishing device according to claim 16, wherein said powder container includes an air filter configured for passing air and blocking powder.

24. A powder replenishing device according to claim 17, wherein said inner container includes an air filter configured for passing air and blocking powder.

25. A powder replenishing device according to claim 4, wherein said powder container has an external shape of a rectangular solid.

26. A powder replenishing device for replenishing powder into an associated apparatus which requires supplementary powder, comprising:

replaceable powder containing means for containing said supplementary powder, said replaceable powder containing means being made of a material which allows a change in a volume thereof and having a powder discharge port for discharging the supplementary powder; and reciprocating means for reciprocating said replaceable powder containing means such that the volume of said replaceable powder containing means is changed on reciprocation and the supplementary powder moves toward said discharge port.

27. A powder replenishing device according to claim 26, wherein said powder discharge port comprises a rigid member.

28. A powder replenishing device according to claim 26, wherein said powder containing means is partially made of a rigid material.

29. A powder replenishing device for replenishing powder into an associated apparatus which requires supplementary powder, comprising:

replaceable powder containing means for containing said supplementary powder, said replaceable powder containing means being made of a material which allows a change in a volume thereof, having an inner container including a powder discharge port, and having a cover container made of a rigid material covering a part of said inner container; and reciprocating means for reciprocating said replaceable powder containing means such that the volume of said replaceable powder containing means is changed on reciprocation and the supplementary powder moves toward said discharge port.

30. A power replenishing device according to claim 29, wherein said reciprocating means reciprocates said powder container with said powder discharge port oriented downward.

31. A power replenishing device according to claim 29, wherein said powder discharge port is disposed in a side wall of the conatainer which is inclined such that the powder in said powder containing means moves toward said powder discharge port by gravity.

32. A powder replenishing device according to claim 29, wherein said reciprocating means is configured to decelerate the container such that the inertia of the powder in the container advances the powder in an advancing direction toward said powder discharge port, said deceleration of the container occurring while the container is moving in the advancing direction.

33. A powder replenishing device according to claim 32, wherein said reciprocating means includes:

urging means for urging said powder containing means to the advancing direction;

means for pressively moving said powder containing means in the retracting direction against an urging force of said urging means;

press releasing means for releasing said powder containing means from movement forced by said means for pressively moving; and stopping means coming in contact with said powder containing means moving in the advancing direction for stopping said powder containing means.

34. A powder replenishing device according to claim 29, wherein said reciprocating means is configured to decelerate the inner container such that an inertia of the supplementary powder in the inner container advances the supplementary powder in an advancing direction toward said powder discharge port, said deceleration of the inner container occurring while the inner container is moving in a retracting direction opposite said advancing direction.

35. A powder replenishing device according to claim 34, wherein said reciprocating means includes:

impact applying means for repeatedly applying said powder containing means with an impact force such that said powder containing means is moved in the retracting direction; and means for moving, in an advancing direction, said powder containing means which has been moved in the retracting direction.

36. A powder replenishing device according to claim 35, wherein said means for moving includes an elastic member disposed between said powder containing means and a device body.

37. A powder replenishing device according to claim 36, wherein said elastic member includes a leaf spring attached to said device body.

38. A powder replenishing device according to claim 36, wherein said elastic member includes an elastic foam.

39. A powder replenishing device according to claim 35, wherein said impact applying means includes:

leaf spring means attached to said device body; and means for moving toward said powder containing means by a resilient force of said leaf spring means to collide with said powder containing means, said means for moving being supported by said leaf spring means.

40. A powder replenishing device according to claim 35, further comprising impact damping means for mitigating an impact force on said device body.

41. A powder replenishing device according to claim 29, wherein said reciprocating means comprises container deforming means for deforming said powder containing means.

42. A powder replenishing device according to claim 29, wherein said reciprocating means comprises container deforming means for deforming said inner container.

43. A powder replenishing device according to claim 41, wherein said container deforming means deforms said powder containing means near said powder discharge port.

44. A powder replenishing device according to claim 42, wherein said container deforming means deforms said inner container near said powder discharge port.

45. A powder replenishing device according to claim 41, wherein said container deforming means fixes said powder container to said device body.

46. A powder replenishing device according to claim 41, further comprising:

container holding means reciprocating together with said powder containing means for supporting said powder containing means for reciprocation, wherein said powder containing means is movable relative to said container holding means in directions of reciprocation, and said container deforming means collides said powder containing means with said container holding means.

47. A powder replenishing device according to claim 42, wherein said inner container is movable relative to said cover container in directions of reciprocation, and said container deforming means collides said inner container with said cover container.

48. A powder replenishing device according to claim 41, wherein said powder containing means includes an air filter for passing air and blocking powder.

49. A powder replenishing device according to claim 42, wherein said inner container includes an air filter for passing air and blocking powder.

50. A powder replenishing device according to claim 29, wherein said powder containing means has an external shape of a rectangular solid.

51. A method of replenishing powder into an associated apparatus which requires supplementary powder, comprising the steps of:

providing a replaceable powder container for containing said supplementary powder, said replaceable powder container being made of a material which allows a change in volume of the container and having a powder discharge port configured to discharge the supplementary powder; and reciprocating said replaceable powder container such that the volume of the replaceable powder container is changed on said reciprocating and the supplementary powder moves toward said discharge port.

52. A method according to claim 51, wherein said powder discharge port comprises a rigid member.

53. A method according to claim 51, wherein said powder container is partially made of a rigid material.

54. A method of replenishing powder into an associated apparatus which requires supplementary powder, comprising the steps of:

providing a replaceable powder container for containing said supplementary powder, said replaceable powder container being made of a material which allows a change in volume of the container, having an inner container including a powder discharge port, and having a cover container made of a rigid material covering a part of said inner container; and reciprocating said replaceable powder container such that the volume of the replaceable powder container is changed on said reciprocating and the supplementary powder moves toward said discharge port.

55. A method according to claim 54, wherein said reciprocating step reciprocates said powder container with said powder discharge port oriented downward.

56. A method according to claim 54, wherein said powder discharge port is disposed on a side wall of the container which is inclined such that the powder in said powder container moves toward said powder discharge port by gravity.

57. A method according to claim 54, wherein the inertia of the powder in the container advances the powder in an advancing direction toward said powder discharge port while the container is moving in the advancing direction.

58. A method according to claim 57, wherein said reciprocating step includes the steps of:

urging said powder container in the advancing direction;

pressively moving said powder container in the retracting direction against the urging force;

releasing said powder container from the movement forced by said pressively moving step; and stopping said powder container moving in the advancing direction.

59. A method according to claim 54, wherein the inertia of the powder in the container advances the powder in an advancing direction toward said powder discharge port while the container is moving in a retracting direction opposite the advancing direction.

60. A method according to claim 59, wherein said reciprocating step includes:

repeatedly applying said powder container with an impact force such that said powder container is moved in the retracting direction; and moving, in an advancing direction, said powder container which has been moved in the retracting direction.

61. A method according to claim 60, wherein said moving step moves said powder container with an elastic member disposed between said powder container and a device body.

62. A method according to claim 61, wherein said elastic member includes a leaf spring attached to said device body.

63. A method according to claim 61, wherein said elastic member includes an elastic foam.

64. A method according to claim 60, wherein said applying step includes the steps of:

providing a leaf spring attached to said device body; and applying a resilient force of said leaf spring to said powder container.

65. A method according to claim 60, further comprising a step of mitigating an impact force to said device body.

66. A method according to claim 64, further comprising a step of deforming said powder container during the reciprocation.

67. A method according to claim 64, further comprising a step of deforming said inner container during the reciprocation.

68. A method according to claim 66, wherein said deforming step deforms said powder container near said powder discharge port.

69. A method according to claim 67, wherein said deforming step deforms said inner container near said powder discharge port.

70. A method according to claim 66, wherein said deforming step reciprocates said powder container with said powder container fixed to said device body.

71. A method according to claim 66, further comprising the steps of:

providing a container holder for reciprocating together with said powder container while supporting said powder container for reciprocation, wherein said powder container is movable relative to said container holder in directions of reciprocation, and said deforming step collides said powder container with said container holder during the reciprocation.

72. A method according to claim 67, wherein said inner container is movable relative to said cover container in directions of reciprocation, and said deforming step collides said inner container with said cover container during the reciprocation.

73. A method according to claim 66, wherein said powder container includes an air filter for passing air and blocking powder.

74. A method according to claim 67, wherein said inner container includes an air filter for passing air and blocking powder.

75. A method according to claim 54, wherein said powder container has an external shape of a rectangular solid.

76. A developing apparatus comprising:

a developer replenishing device configured to replenish a developer into a developer replenishing unit in said developing apparatus, said developer replenishing device including, a replaceable developer container configured to contain said developer and made of a material which allows a change in volume of the replaceable developer container, said replaceable developer container having a developer discharge port configured to discharge the developer and a reciprocating mechanism configured to reciprocate said replaceable developer container such that the volume of the replaceable developer container is changed on reciprocation and the developer moves toward said discharge port.

77. A developing apparatus according to claim 76, wherein said developer discharge port comprises a rigid member.

78. A developing apparatus according to claim 76, wherein said developer container is partially made of a rigid material.

79. A developing apparatus comprising:

a developer replenishing device configured to replenish a developer into a developer replenishing unit in said developing apparatus, said developer replenishing device including, a replaceable developer container configured to contain a developer and made of a material which allows a change in volume of the replaceable developer container, said replaceable developer container having an inner container including a developer discharge port configured to discharge the developer and having a cover container made of a rigid material covering a part of said inner container; and a reciprocating mechanism configured to reciprocate said replaceable developer container such that the volume of the replaceable developer container is changed on reciprocation and the developer moves toward said discharge port.

80. A developing apparatus according to claim 79, wherein said reciprocating mechanism reciprocates said developer container with said developer discharge port oriented downward.

81. A developing apparatus according to claim 79, wherein said developer discharge port is disposed in a side wall of the container which is inclined such that the developer in said developer container moves toward said developer discharge port due to gravity.

82. A developing apparatus according to claim 79, wherein said reciprocating mechanism is configured to decelerate the container such that the inertia of the developer in the container advances the developer in an advancing direction toward said developer discharge port, said deceleration of the container occurring while the container is moving in the advancing direction.

83. A developing apparatus according to claim 82, wherein said reciprocating mechanism includes:

an urging mechanism configured to urge said developer container in the advancing direction;

a pressively-moving mechanism configured to pressively move said developer container in a retracting direction against an urging force of said urging mechanism;

a press releasing mechanism configured to release said developer container from the movement forced by said pressively-moving mechanism; and a stopper positioned to come in contact with said developer container moving in the advancing direction to stop said developer container.

84. A developing apparatus according to claim 79, wherein said reciprocating mechanism is configured to decelerate the container such that the inertia of the developer in the container advances the developer in an advancing direction toward said developer discharge port, said deceleration of the container occurring while the container is moving in a retracting direction opposite said advancing direction.

85. A developing apparatus according to claim 84, wherein said reciprocating mechanism includes:

an impact applying mechanism configured to repeatedly apply said developer container with an impact force such that said developer container is moved in the retracting direction; and a moving mechanism configured to move, in an advancing direction, said developer container which has been moved in the retracting direction.

86. A developing apparatus according to claim 85, wherein said moving mechanism includes an elastic member disposed between said developer container and a device body in the retracting direction.

87. A developing apparatus according to claim 86, wherein said elastic member includes a leaf spring attached to said device body.

88. A developing apparatus according to claim 86, wherein said elastic member includes an elastic foam.

89. A developing apparatus according to claim 85, wherein said impact applying mechanism includes:

a leaf spring attached to said device body; and a moving mechanism configured to move toward said developer container by a resilient force of said leaf spring to collide with said developer container, said moving mechanism being supported by said leaf spring.

90. A developing apparatus according to claim 85, wherein said developer replenishing device further comprising an impact damping mechanism configured to mitigate an impact force to said device body.

91. A developing apparatus according to claim 79, wherein said reciprocating mechanism comprises a container deforming mechanism configured to deform said developer container.

92. A developing apparatus according to claim 79, wherein said reciprocating mechanism comprises a container deforming mechanism configured to deform said inner container.

93. A developing apparatus according to claim 91, wherein said container deforming mechanism is configured to deform said developer container near said developer discharge port.

94. A developing apparatus according to claim 92, wherein said container deforming mechanism is configured to deform said inner container near said developer discharge port.

95. A developing apparatus according to claim 91, wherein said container deforming mechanism fixes said developer container to said device body.

96. A developing apparatus according to claim 91, wherein said developer replenishing device further comprises:

a container holding member configured to reciprocate together with said developer container while supporting said developer container for reciprocation, wherein said developer container is movable relative to said container holding member in directions of reciprocation, and said container deforming mechanism is configured to collide said developer container with said container holding member.

97. A developing apparatus according to claim 92, wherein said inner container is movable relative to said cover container in directions of reciprocation, and said container deforming mechanism is configured to collide said inner container with said cover container.

98. A developing apparatus according to claim 91, wherein said developer container includes an air filter configured for passing air and blocking developer.

99. A developing apparatus according to claim 92, wherein said inner container includes an air filter configured for passing air and blocking developer.

100. A developing apparatus according to claim 79, wherein said developer container has an external shape of a rectangular solid.

101. A developing apparatus according to claim 79, including a developer contained in said developer container, wherein said developer contained in said developer container includes toner.

102. A developing apparatus according to claim 79, including a developer contained in said developer container, wherein said developer contained in said developer container includes carriers.

103. A developing apparatus according to claim 79, including a developer contained in said developer container, wherein said developer contained in said developer container includes toner and carriers.

104. An image forming apparatus comprising:

a developing unit configured to develop a latent image formed on an image carrier; and a developer replenishing device configured to replenish a developer into said developing unit, said developer replenishing device including, a replaceable developer container configured to contain said developer and made of a material which allows a change in volume of the replaceable developer container, said replaceable developer container having a developer discharge port configured to discharge the developer, and a reciprocating mechanism configured to reciprocate said replaceable developer container such that the volume of said replaceable developer container is changed on reciprocation and the developer moves toward said discharge port.

105. An image forming apparatus according to claim 104, wherein said developer discharge port comprises a rigid member.

106. An image forming apparatus according to claim 104, wherein said developer container is partially made of a rigid material.

107. An image forming apparatus comprising:

a developing unit configured to develop a latent image formed on an image carrier; and a developer replenishing device configured to replenish a developer into said developing unit, said developer replenishing device including, a replaceable developer container configured to contain said developer and made of a material which allows a change in volume of the replaceable developer container, said replaceable developer container having an inner container formed with a developer discharge port configured to discharge the developer and having a cover container made of a rigid material covering a part of said inner container, and a reciprocating mechanism configured to reciprocate said replaceable developer container such that a volume of the inner container is changed on reciprocation and the developer moves toward said discharge port.

108. An image forming apparatus according to claim 107, wherein said reciprocating mechanism reciprocates said developer container with said developer discharge port oriented downward.

109. An image forming apparatus according to claim 107, wherein the developer discharge port is disposed in a side wall of the container which is inclined such that the developer in said developer container moves toward said developer discharge port due to gravity.

110. An image forming apparatus according to claim 107, wherein said reciprocating mechanism is configured to decelerate the inner container such that an inertia of the developer in the inner container advances the developer in an advancing direction toward said developer discharge port, said deceleration of the inner container occurring while the inner container is moving in the advancing direction.

111. An image forming apparatus according to claim 110, wherein said reciprocating mechanism includes:

an urging mechanism configured to urge said developer container in the advancing direction;

a pressively-moving mechanism configured to pressively move said developer container in a retracting direction against an urging force of said urging mechanism;

a press releasing mechanism configured to release said developer container from the movement forced by said pressively-moving mechanism; and a stopper positioned to come in contact with said developer container moving in the advancing direction to stop said developer container.

112. An image forming apparatus according to claim 107, wherein said reciprocating mechanism is configured to decelerate the container such that the inertia of the developer in the container advances the developer in an advancing direction toward said developer discharge port, said deceleration of the container occurring while the container is moving in a retracting direction opposite said advancing direction.

113. An image forming apparatus according to claim 112, wherein said reciprocating mechanism includes:

an impact applying mechanism configured to repeatedly apply said developer container with an impact force such that said developer container is moved in the retracting direction; and a moving mechanism configured to move, in an advancing direction, said developer container which has been moved in the retracting direction.

114. An image forming apparatus according to claim 113, wherein said moving mechanism includes an elastic member disposed between said developer container and a device body.

115. An image forming apparatus according to claim 114, wherein said elastic member includes a leaf spring attached to said device body.

116. An image forming apparatus according to claim 114, wherein said elastic member includes an elastic foam.

117. An image forming apparatus according to claim 113, wherein said impact applying mechanism includes:

a leaf spring attached to said device body; and a moving mechanism configured to move toward said developer container by a resilient force of said leaf spring to collide with said developer container, said moving mechanism being supported by said leaf spring.

118. An image forming apparatus according to claim 113, wherein said developer replenishing device further comprising an impact damping mechanism configured to mitigate an impact force to said device body.

119. An image forming apparatus according to claim 107, wherein said reciprocating mechanism comprising a container deforming mechanism configured to deform said developer container.

120. An image forming apparatus according to claim 107, wherein said reciprocating mechanism comprising a container deforming mechanism configured to deform said inner container.

121. An image forming apparatus according to claim 119, wherein said container deforming mechanism is configured to deform said developer container near said developer discharge port.

122. An image forming apparatus according to claim 120, wherein said container deforming mechanism is configured to deform said inner container near said developer discharge port.

123. An image forming apparatus according to claim 119, wherein said container deforming mechanism fixes said developer container to said device body.

124. An image forming apparatus according to claim 119, wherein said developer replenishing device further comprises:

a container holding member configured to reciprocate together with said developer container while supporting said developer container for reciprocation, wherein said developer container is movable relative to said container holding member in directions of reciprocation, and said container deforming mechanism is configured to collide said developer container with said container holding member.

125. An image forming apparatus according to claim 120, wherein said inner container is movable relative to said cover container in directions of reciprocation, and said container deforming mechanism is configured to collide said inner container with said cover container.

126. An image forming apparatus according to claim 119, wherein said developer container includes an air filter configured for passing air and blocking developer.

127. An image forming apparatus according to claim 120, wherein said inner container includes an air filter configured for passing air and blocking developer.

128. An image forming apparatus according to claim 107, wherein said developer container has an external shape of a rectangular solid.

129. An image forming apparatus according to claim 107, including a developer contained in said developer container, wherein said developer contained in said developer container includes toner.

130. A developing apparatus according to claim 107, including a developer contained in said developer container, wherein said developer contained in said developer container includes carriers.

131. A developing apparatus according to claim 107, including a developer contained in said developer container, wherein said developer contained in said developer container includes toner and carriers.

* * * * *